United States Patent [19]

White

[11] 4,038,495

[45] July 26, 1977

[54] SPEECH ANALYZER/SYNTHESIZER USING RECURSIVE FILTERS

[75] Inventor: Stanley A. White, Yorba Linda, Calif.

[73] Assignee: Rockwell International Corporation, El Segundo, Calif.

[21] Appl. No.: 632,119

[22] Filed: Nov. 14, 1975

[51] Int. Cl.[2] ..... G10L 1/00

[52] U.S. Cl. ..... 179/1 SA

[58] Field of Search ..... 179/1 SA, 1 SC, 15 BF; 325/42, 41

[56] References Cited

U.S. PATENT DOCUMENTS

| | | | |
|---|---|---|---|
| 3,154,738 | 10/1964 | Greene | 179/15 BF |
| 3,624,302 | 11/1971 | Atal | 179/1 SA |
| 3,648,171 | 3/1972 | Hirsh | 325/42 |
| 3,649,765 | 3/1972 | Rabiner | 179/1 SA |
| 3,692,939 | 9/1972 | Knight et al. | 179/15 BF |
| 3,740,476 | 6/1973 | Atal | 179/1 SC |
| 3,890,572 | 6/1975 | Desblanche | 325/42 |

OTHER PUBLICATIONS

Atal and Schroeder, "Adaptive Prediction Coding of Speech Signals." Bell Sys. Tech. J., Oct. 1970, pp. 1973, 1982.

Kaiser, "The Digital Filter and Speech Communication" IEEE Trans. Audio and EA, June, 1968.

Flanagan, "Speech Analysis, Synthesis & Perception" 2nd Ed., Springer-Verlag, 1972, pp. 368, 400.

Itakura; Saito, "Digital Filtering Techniques for . . . " Seventh Int. Congress in Acoustics, Budapest, 1971.

*Primary Examiner*—Kathleen H. Claffy
*Assistant Examiner*—E. S. Kemeny
*Attorney, Agent, or Firm*—H. Fredrick Hamann; Rolf M. Pitts; George Jameson

[57] ABSTRACT

A speech analyzer and synthesizer features a digital adaptive linear predictor, using a recursive (rather than transversal) filter in a negative feedback loop which develops both feedforward and feedback filter coefficients. An input circuit is responsive to an input speech signal and to a first synthesized speech signal for developing an error signal. An output circuit is responsive to the error signal and to first state signals for developing multiplexed speech data signals. The multiplexed speech data signals are fed back, demultiplexed and applied to a first recursive filter to control the development of the first synthesized speech signal and the first state signals by the first recursive filter. The multiplexed speech data signals from the output circuit are also transmitted to a receiver which demultiplexes and applies the demultiplexed received speech data signals to a second recursive filter to control the development of a second synthesized speech signal by the second recursive filter. This second synthesized speech signal is then converted into an output speech signal which substantially sounds like the input speech signal.

14 Claims, 17 Drawing Figures

SPEECH ANALYZER/SYNTHESIZER USING RECURSIVE FILTERS

BACKGROUND OF THE INVENTION

1. Field of the Invention

This invention relates to speech communication systems and particularly to a speech communication system utilizing adaptive recursive filters.

2. Description of the Prior Art

Many types of prior art speech communications systems have been proposed. In U.S. Pat. No. 3,750,024 (Dunn et al.) there is disclosed a system which determines redundant information in a speech to be transmitted and removes that redundant information to produce a residual signal. At least one parameter of the redundant information is also determined. This parameter and the residual signal are multiplexed for transmission. The transmitted signal is demultiplexed in a receiver, with the resultant parameter and residual signal being used to control the operation of a filter and hence the subsequent reconstruction of the speech for utilization. In this system the transmit filter uses only input samples. No feedback path is provided between the output of the transmitter and the transmit filter to modify any filter parameters. As taught in Dunn et al. the digitally converted speech information is directly processed to develop the redundant information which is subtracted from the digitally converted speech. The filter coefficients in Dunn et al. are developed by directly analyzing the speech information. More specifically, the filter coefficients are adjusted to the input signal by computing a short term correlation function from the input samples. The best fit of the filter's response to the input spectrum is obtained by minimizing the mean square value of the output signal of the transmit filter with respect to each of the weights to subsequently lead to the optimum weights. Inverse filters are used in both the transmitter and receiver of this system. No recursive filters are used in this system.

An article by Atal and Schroeder is referenced in Column 2, line 50 et seq. of Dunn et al. This article deals with a predictive quantizer system which, like that of Dunn et al., uses short term correlation in its system operation. The system in the cited article uses only output samples to drive the predictor, whereas the system of Dunn et al. uses only input samples. Neither of these systems utilizes both input and output samples in its operation.

Another approach is briefly described in Column 5, line 8 et seq. of Dunn et al., wherein a prior art system is described as monitoring the level of the prediction and comparing it to the level of the input signal. In this approach, if the level of the prediction is not less than the level of the input signal with which it is being compared, the system assumes something is wrong, and forces the prediction to zero at that time. There appear to be two ways of forcing the prediction to zero. The system can either force all filter states to zero or force all filter coefficients to zero in order to zero the prediction. However, as indicated in Column 5, lines 14–17 of Dunn et al., this operation would diminish the advantage of having the prediction in the first place. It would further act to increase the error in the final output during the time that the system is forcing the prediction to zero, since nothing would be compared to the level of the input signal at that time.

Another system is described in U.S. Pat. No. 3,745,562 (Rosenbaum). Rosenbaum teaches an analog-to-digital encoder which uses an N dimensional quantizer to generate from an input analog signal N digits of an output code for transmission. An error signal, derived from past and future inputs, is applied to a tapped delay line, the outputs of which are multiplied by a coefficient for correcting errors in the input signal. However, the error signal is not utilized to adjust filter parameters.

U.S. Pat. No. 3,715,666 (Mueller) teaches a start-up system for a transversal equalizer in which a received signal is processed by a digital filter and compared with a locally generated data stream identical to the transmitted data for generating an error signal to correct filter parameters.

None of the above-described systems teach the provision of a transmitter containing an adaptive recursive filter in a control loop simulating an adaptive recursive filter in a receiver. It should also be noed that many prior art adaptive filters used in speech coding systems basically use transversal filter structures because their convergence requirements are known. A system utilizing adaptive recursive filters would be more powerful because the recursive filter has both poles and zeros. However, no prior art has been found by applicant that could make a recursive filter adapt or that would indicate that the convergence requirements for an adaptive recursive filter was heretofore known.

SUMMARY OF THE INVENTION

Briefly, an improved speech analyzer/synthesizer system is provided which uses adaptive recursive filters. In a preferred embodiment an input speech signal is compared with a transmitter synthesized speech signal to develop an error signal. This error signal is processed in two channels to develop excitation and coefficient signals, which are encoded and multiplexed for transmission to a receiver. The transmitted multiplexed data is demultiplexed and decoded in the receiver to establish the coefficient and excitation signals to set the poles and zeros of an adaptive recursive filter in the receiver. A synthesized speech signal from the receiver recursive filter is then processed to reconstruct the input speech signal. To minimize the introduction of distortion in the system by the transmitter encoding and multiplexing operations and receiver demultiplexing and decoding operations, the transmitter also includes an adaptive feedback control loop. This adaptive control loop comprises a complete duplication of the receiver demultiplexing and decoding operations to establish the coefficient and excitation signals to set the poles and zeros of a model adaptive recursive filter. This model recursive filter also corresponds to that of the receiver and adapts to the demultiplexed and decoded excitation and coefficient signals to develop the transmitter synthesized speech signal which is utilized to develop the error signal.

It is therefore an object of this invention to provide an improved speech communication system.

Another object of this invention is to provide a speech analyzer/synthesizer system which utilizes adaptive recursive filters.

Another object of this invention is to provide a speech communication system wherein the transmitter includes a recursive filter in a feedback control loop which simulates the operation of a recursive filter in the receiver.

Another object of this invention is to provide a speech communication system which uses both input and output samples in developing estimates of an input speech for transmission.

Another object of this invention is to provide a speech communication system which develops the coefficient computations to adaptively set the parameters of a recursive filter.

A further object of this invention is to provide a digital speech communication system which utilizes an adaptive servo loop in the transmitter to minimize functionals of the instantaneous error between the digitized speech input signal and a first synthesized speech signal.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawings wherein like reference numerals indicate like or corresponding parts throughout the several views and wherein.

DESCRIPTION OF THE PREFERRED EMBODIMENT

Figure 1:
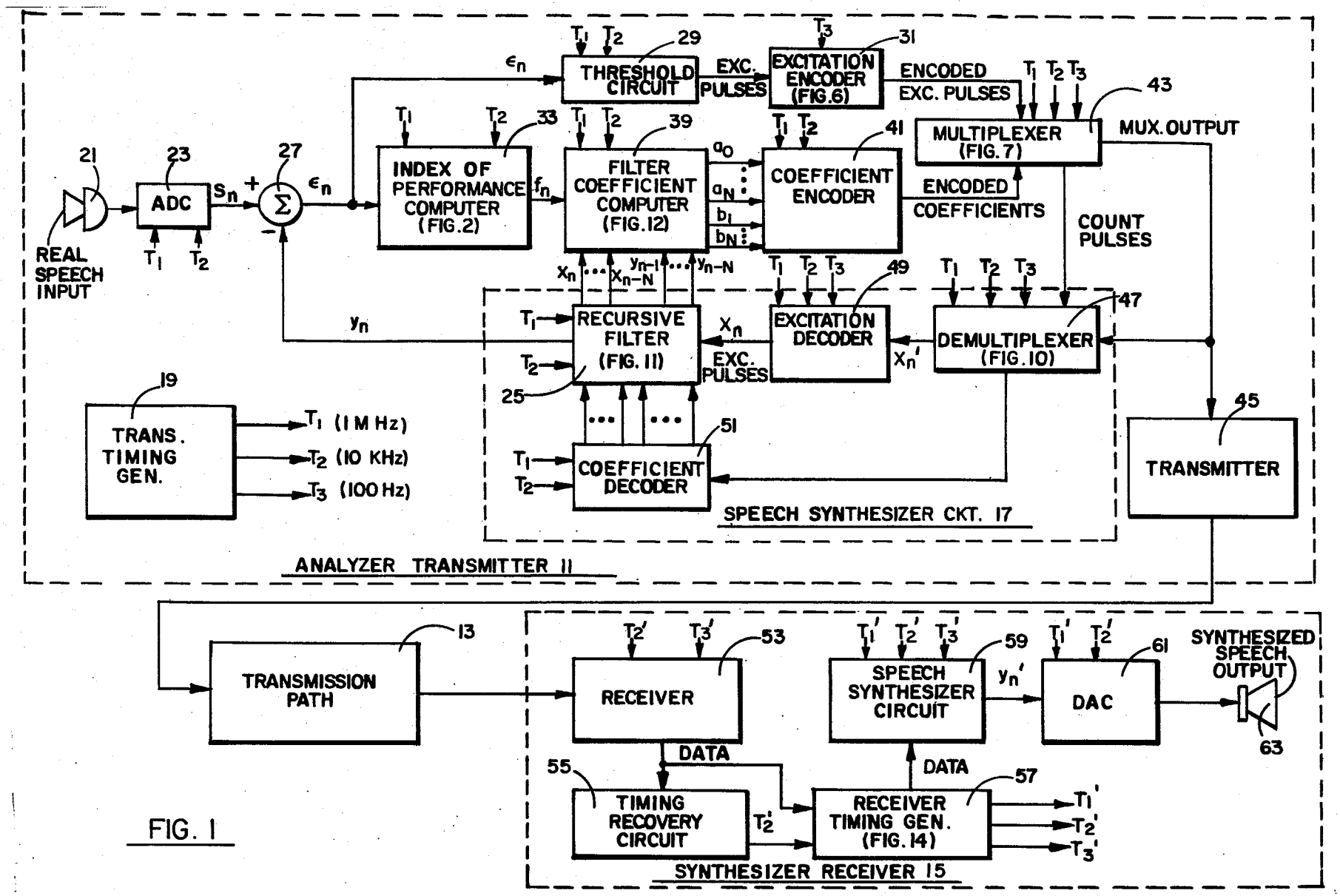
FIG. 1 is a block diagram of a preferred embodiment of the invention.

Referring now to the drawings, FIG. 1 discloses a block diagram of a preferred embodiment of the invention. An analyzer transmitter 11 digitizes and analyzes an input analog signal and transmits a resultant digitized signal through a transmission path 13, such as through a radio propagation path, a telephone line or a cable television network, to a synthesizer receiver 15 which synthesizes the input analog signal at its output. The transmitter 11 includes an adaptive servo loop having a feedback correction path or speech synthesizer circuit 17 which comprises a duplication of part of the synthesizer receiver 15 to minimize the transmission of errors in the resultant signal. The transmitter 11 and synthesizer receiver 15 will now be separatedly discussed.

Within the analyzer transmitter 11 is a transmitter timing generator 19, which can be comprised of clock generator and countdown circuits (not shown) to develop output clock signals $T_1$, $T_2$ and $T_3$ at exemplary frequencies of 1 MHz, 10 KHz and 100 Hz, respectively.

In the operation of the transmitter 11, an input analog speech signal, which may have a bandpass of 300 to 3000 Hz, is passed through an input speech transducer or microphone 21 to an analog-to-digital converter (ADC) 23 which samples the speech signal at the $T_2$ rate of 10 KHz. A sampling rate of 10 KHz is chosen here since it is greater than the exemplary 3 KHz bandwidth of the input speech signal by a factor of comfortably more than two. The amplitude of the sampled speech signal is serially fed out of the converter 23 as a digitized speed signal $s_n$ at the $T_1$ bit rate of 1 MHz. A synthesized digitized speech signal $y_n$, which is a synthesized version of the input speech signal, is developed at a $T_1$ bit rate and a $T_2$ word rate by a recursive filter 25 in the speech synthesizer circuit 17 (to be discussed). Each of the output samples in the synthesized speech signal $y_n$ is intended to match an associated sample in the incoming digitized speech signal $s_n$. Therefore, the synthesized speech signal $y_n$ is subtracted from the actual speech signal $s_n$ in a combiner or subtractor circuit 27 to develop an error signal $\epsilon_n$ to show any mismatch between the $y_n$ and $s_n$ signals.

The filter 25 is a model of the vocal tract which, in generating the synthesized speech signal $y_n$, is trying to approximate the digitized input speech signal $s_n$ in order to drive the error signal $\epsilon_n$ to zero. If the filter 25 did a perfect job of duplicating the signal $s_n$, the error signal $\epsilon_n$ at the output of the combiner 27 would be zero. However, as a practical matter, there will almost always be some error signal $\epsilon_n$, since any mismatch of the $y_n$ and $s_n$ signals will cause the combiner 27 to develop the error signal $\epsilon_n$. Like the signals $s_n$ and $y_n$, the error signal $\epsilon_n$ is a serial bit stream, which may be 16 bits in length.

The error signal $\epsilon_n$ essentially contains two components. One component is a relatively low level residual signal which exists because of transfer function errors within the recursive filter 25. The second component comprises a string of pulses of relatively high amplitude which are superimposed upon the residual signal. These relatively high amplitude pulses are pitch period excitation pulses which define the pitch or frequency of the input analog speech signal in relation to time.

The excitation pulses are separated from the error signal $\epsilon_n$ by a threshold circuit 29. The threshold circuit 29 can evaluate the error signal $\epsilon_n$ for a threshold crossing at the $T_1$ clock rate and supply any detected excitation pulse to an excitation encoder 31 in synchronism with the following $T_2$ clock. Any suitable excitation encoder may be employed for encoding the excitation pulses, such as a pulse code modulation encoder or a binary coded decimal encoder.

The error signal $\epsilon_n$ is also applied to an index of performance computer 33 which essentially utilizes the low level residual signal. This residual signal is a measure of how badly the filter coefficients $a_o$, $a_1 \ldots a_N$ and $b_1 \ldots b_N$ have been set up in the filter 25 during the development of the synthesized speech signal $y_n$. For purposes of the ensuing discussion, N will be set equal to 5. The filter 25 and the development of these coefficients will be discussed later in more detail.

Figure 2:
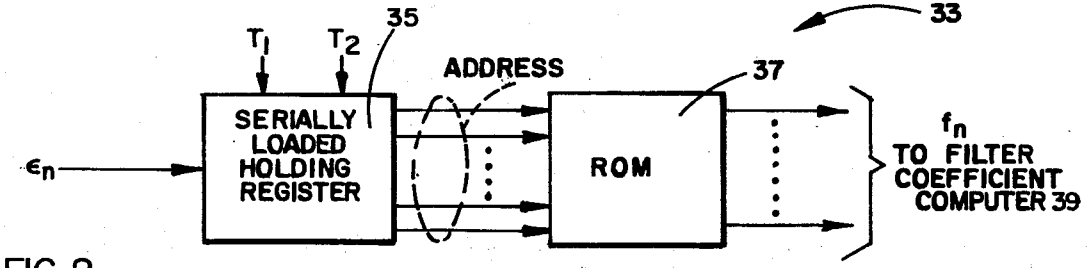
FIG. 2 is a block diagram of the index of performance computer of FIG. 1.

The index of performance computer 33 is illustrated in FIG. 2. As shown in FIG. 2, the bits in the error signal $\epsilon_n$ are serially clocked into a serially loaded holding register 35 by the $T_1$ clocks. The register 35 can be comprised of a plurality of cascaded flip flops (not shown) for storing the serial bits in the error signal $\epsilon_n$. At the time of the $T_2$ clock the states of the flip flops in the register 35 are used as a parallel address to cause a read only memory (ROM) 37 to develop an associated scalar derivative $f_n$ from a preselected performance index or performance criterion $F(\epsilon)$. The preselected performance criterion $F(\epsilon)$ is designed into the index of performance computer 33 by having the ROM 37 store a set of points which approximate the scalar derivative of the desired performance criterion $F(\epsilon)$. Each scalar derivative value is equal to the derivative of the desired performance criterion $F(\epsilon)$ with respect to the associated value of the error signal $\epsilon_n$. Each input address word from the register 35 tells the ROM 37 to loop up that point on the stored curve that corresponds to the associated scalar word or value $f_n$ out.

Figure 5A:
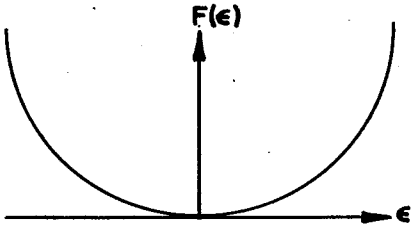
FIGS. 3A, 3B, 4A, 4B, 5A and 5B illustrate waveforms useful in explaining the basic operation of the index of performance computer of FIG. 2.
Figure 4A:
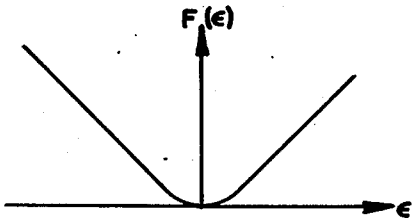
Figure 3A:
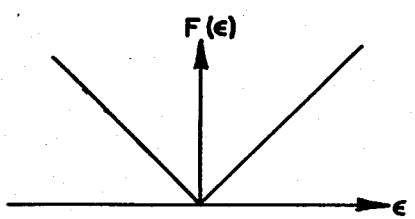

Examples of some of the possible shapes of performance criterion $F(\epsilon)$ that can be designed into the computer 33 are illustrated in FIGS. 3A, 4A and 5A. The resulting computing functions $f_n$ associated with the shapes illustrated in FIGS. 3A, 4A and 5A are respectively shown in FIGS. 3B, 4B and 5B. It can be readily seen that the derivative of $F(\epsilon)$ with respect to the error $\epsilon_n$ will produce the associated $f_n$.

Figure 5B:
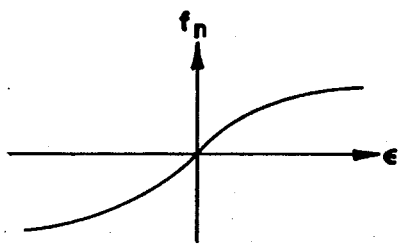
Figure 4B:
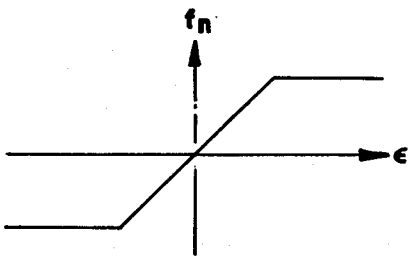
Figure 3B:
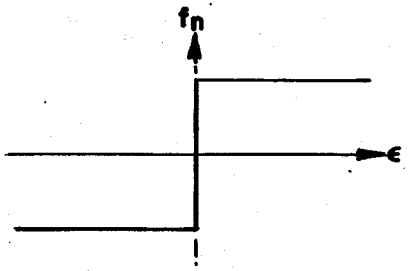

In FIG. 3B, $f_n$ is obtained by taking only the sign of the error $\epsilon_n$. The resulting performance criterion $F(\epsilon)$ of FIG. 3A is the minimization of the magnitude of the error $\epsilon_n$. In FIG. 4B the error $\epsilon_n$ is used as $f_n$, which is obtained by employing saturation arithmetic. The resulting performance criterion $F(\epsilon)$, shown in FIG. 4A, is the minimization of the square of the error $\epsilon_n$ in the linear region of FIG. 4B. A somewhat arbitrary curve is illustrated in FIG. 5B for developing the scalar derivatives $f_n$ of the performance criterion $F(\epsilon)$ shown in FIG. 5A.

Returning now to FIG. 1, the scalar derivative $f_n$ from the computer 33 is applied to a filter coefficient computer 39 to tell the computer 39 how badly the computer 39 has performed in previously generating the coefficients $a_o$, $a_1 \ldots a_N$ and $b_N$ and $b_1 \ldots b_N$ for developing the synthesized signal $y_n$. Also applied to the computer 39 are the filter state components $x_n$, $x_{n-1} \ldots x_{n-N}$ and $y_{n-1} \ldots y_{n-N}$ of the filter 25, where it has been previously stated that $N = 5$ for purposes of this discussion. The filter 25 state is a set of data which is stored in the filter and uniquely describes the signal in the filter 25 at any moment. The filter coefficient computer 39 utilizes the scalar derivative $f_n$ and that state of the filter 25 to compute a new set of coefficients $a_o$, $a_1 \ldots a_5$ and $b_1 \ldots b_5$ for the filter 25 in order to minimize the magnitude of the error signal $\epsilon_n$ and hence to minimize the slope of the performance criterion $F(\epsilon)$ of the computer 33. The computer 39 uses the $T_1$ and $T_2$ clocks for bit and word timing operations in computing each new set of these coefficients.

The coefficients $a_o$, $a_1 \ldots a_5$ are the numerator coefficients for the transfer function of the recursive filter 25 which determine the zero values of the filter 25, while the coefficients $b_1 \ldots b_5$ are the denominator coefficients of the transfer function of the filter 25 which determine the pole values of the filter 25. Each of these coefficients $a_o$, $a_1 \ldots a_5$ and $b_1 \ldots b_5$ can be internally computed within the computer 39 to an accuracy of, for example, 16 bits. However, because of the relatively slow rate of change of these coefficients, only the most significant eight bits of each will need to be subsequently utilized by the system to produce the signal $y_n$ and to synthesize the speech signal $y_n'$ in the synthesizer receiver 15.

The most significant eight bits of each of the coefficients $a_o$, $a_1 \ldots a_5$ and $b_1 \ldots b_5$ are loaded into a coefficient encoder 41 (at a bit rate of the $T_1$ clock and a word rate of the $T_2$ clock) to obtain data compaction before transmission to the synthesizer receiver 15. Any suitable coefficient encoder may be employed, such as a pulse code modulation encoder or a binary coded decimal encoder. It is not necessary that the encoders 31 and 41 employ the same encoding technique as long as each can handle the bandwidth of its input signal. The encoded coefficient data from the coefficient encoder 41 and the encoded excitation data from the excitation encoder 31 are multiplexed together in a multiplexer 43 to blend the two data streams into one output data stream. For timing recovery purposes an end-of-message code may be included in the multiplexed output to indicate the end of a frame period (period of a $T_3$ clock). During each frame period a sequence of updated excitation and coefficient data, as well as the end-of-message code, is developed by the multiplexer 43. The multiplexer 43 may be any suitable multiplexer, such as a time-division multiplexer or a frequency-division multiplexer. For purposes of this discussion the multiplexer 43 will be selected to perform a time-division multiplexing operation. The clock pulses $T_1$, $T_2$ and $T_3$ can be utilized by the multiplexer 43 to perform this operation.

It should be noted that the encoded data from the encoders 31 and 41 can be in a serial or parallel data format. If a serial data format is chosen, then the multiplexer 43 should include, for example, shift registers to store that serial data so that it can be multiplexed at the desired times. Where a parallel data format is utilized, each of the lines in FIG. 1 drawn from the encoders 31 and 41 to the multiplexer 43 is a composite line representing multiple parallel inputs to the multiplexer 43.

The multiplexed output of the multiplexer 43 is applied to a suitable transmitter 45 for transmission through the transmission path 13 to th synthesizer receiver 15. The output of the multiplexer 43 is also applied to the speech synthesizer circuit 17, which is attempting to develop a synthesized speech signal $y_n$ which will drive the residual or error signal $\epsilon_n$ to zero at the output of the combiner 27. More specifically, the multiplexer 43 output data stream is demultiplexed into two streams of encoded coefficient and excitation data signals by a demultiplexer 47, which operates in a reverse manner from that of the selected multiplexer 43. Count pulses from the multiplexer 43, as well as the $T_1$, $T_2$ and $T_3$ clocks, can be used by the demultiplexer 47 in its demultiplexing operation. The encoded excitation and coefficient data signals from the demultiplexer 47 are respectively decoded by excitation and coefficient decoders 49 and 51 to generate and apply an excitation signal $x_n$, containing excitation pulses, and the present set of coefficient signals $a_o$, $a_1 \ldots a_5$, and $b_1 \ldots b_5$ to the recursive filter 25 to internally set the values of the filter 25. In response to these input signals, the model filter 25 generates the synthesized speech signal $y_n$ and a new set of filter state signals $x_n$, $x_{n-1} \ldots x_{n-5}$ and $y_{n-1} \ldots y_{n-5}$. As indicated earlier, the synthesized signal $y_n$ is subtracted in the combiner 27 from the incoming speech signal $s_n$ to develop a new value of the error signal $\epsilon_n$, while this new set of filter state signals is utilized by the computer 39, along with the scalar derivative signal $f_n$ from the computer 33, to develop a new set of coefficients $a_o$, $a_1 \ldots a_5$ and $b_1 \ldots b_5$. Therefore, at any given instant of time, the speech synthesizer circuit 17 in the analyzer transmitter 11 acts to minimize the error signal $\epsilon_n$, and thus to minimize the magnitude of the scalar $f_n$ at the output of the computer 33. As a consequence, the analyzer transmitter 11 also minimizes the performance criterion $F(\epsilon)$.

The synthesizer receiver 15 of FIG. 1 will now be further discussed. The multiplexed data signal transmitted from the transmitter 45 through the transmission path 13 is received by a receiver 53 in the synthesizer receiver 15. The receiver 53 applies the multiplexed signal to a conventional timing recovery circuit 55. For example, the timing recovery circuit 55 may contain a stable clock and frequency divider chain which utilize zero-crossings of the received signal to synchronize the output of this frequency divider chain. Since these zero-crossings may contain "time jitter", averaging over several zero crossings (or the approximate equivalent of such averaging) is used to establish the correct synchronism of the timing recovery output. This type of timing recovery is well known in the art and is described in relation to FIGS. 2 and 13 of U.S. Pat. Nos. 3,651,316 and 3,638,122, respectively.

The timing recovery circuit 55 recovers the transmitted bit rate of 10 KHz from the multiplexed data. This recovered bit rate signal of 10 KHz at the output of the timing recovery circuit 55 will be designated as the $T_2'$ clock to distinguish it from the $T_2$ clock generated by the transmitter timing generator 19 in the analyzer transmitter 11. The $T_2'$ clock from the timing recovery circuit 55 and the multiplexed data from the receiver 53 are applied to a receiver timing generator 57. The receiver timing generator 57 utilizes the end-of-message code in the multiplexed data and the $T_2'$ clock to develop a 100 Hz clock $T_3'$ and a 1 MHz clock $T_1'$ which are synchronized to the $T_3$ and $T_1$ clocks, respectively, in the transmitter 11. These $T_1'$ and $T_3'$ clocks, as well as the $T_2'$ clock, are then selectively used to perform the desired timing operations for the circuits of the synthesizer receiver 15.

The receiver timing generator 57 also removes the end-of-message code from the multiplexed data and applies the rest of the multiplexed data in each frame period to a speech synthesizer circuit 59, which is similar in structure and operation to the speech synthesizer circuit 17 in the analyzer transmitter 11. It should be noted at this time that the model adaptive recursive filter 25 in the speech synthesizer circuit 17 corresponds in structure and operation to a receiver adaptive recursive filter (not shown) in the speech synthesizer circuit 59 of the synthesizer receiver 15. Basically, the tested performance of the model filter 25 is taken as a prediction or estimate of the performance of the receiver filter in the circuit 59. Thus, when the multiplexed, encoded coefficient and excitation data are demultiplexed and decoded in the circuit 59, the resultant receiver coefficient data and excitation pulses (not shown) are used to control the adaptive recursive filter in the circuit 59 to provide optimum receiver performance in the synthesizer receiver 15. However, in accomplishing this task the circuit 59 is only utilized to synthesize a digitized speech signal $y_n'$ which is substantially identical to the synthesized speech signal $y_n$ and to the actual speech signal $s_n$ in the analyzer transmitter 11. The digital speech signal $y_n'$ is converted into a synthesized analog speech signal by a digital-to-analog converter (DAC) 61, before being applied to a speech utilization device or speaker 63. The synthesized speech output from the speaker 63 in the receiver 15 is substantially identical to the real speech input to the microphone 21 in the transmitter 11, although somewhat delayed in time therefrom.

Figure 6:
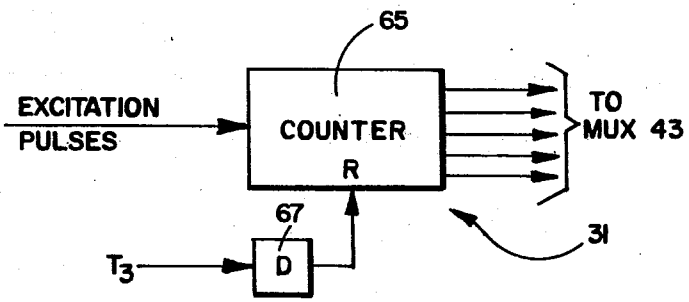
FIG. 6 illustrates a block diagram of one type of excitation encoder which may be used in FIG. 1.

One type of excitation encoder 31 that can be used in the system of FIG. 1 is illustrated in FIG. 6. In FIG. 6, the excitation pulses from the threshold circuit 29 are applied to a counter 65. This counter 65 counts the number of excitation pulses which occur within the period of the $T_3$ clock (1/100 of a second). It will be recalled that the input speech signal to the converter 23 (FIG. 1) was stated to have a bandpass of 300 to 3000 Hz. So there cannot be more than 3000 excitation pulses occurring in one second, or more than 30 excitation pulses occurring within the period of the $T_3$ clock. Consequently, the counter 65 can be a five-bit counter. The $T_3$ clock is suitably delayed by a delay circuit 67 before it resets the counter 65 to a zero count. This delay circuit 67 can be internally built into the counter 65. A slight delay is necessary to allow the multiplexer 43 to read the excitation pulse count information out of the counter 65 before the counter 65 is reset.

With the type of excitation encoder 31 of FIG. 6 being utilized in FIG. 1, the excitation decoder 49 of FIG. 1 could be a digital pulse rate multiplier or a digital equivalent of a voltage controlled oscillator (not shown), which puts out a stream of excitation pulses at a frequency proportional to the value of the five bit excitation word being applied to decoder 49. The $T_1$, $T_2$ and $T_3$ clocks may be used by the decoder 49 in its operation to provide the proper bit, word and frame timing.

Figure 7:
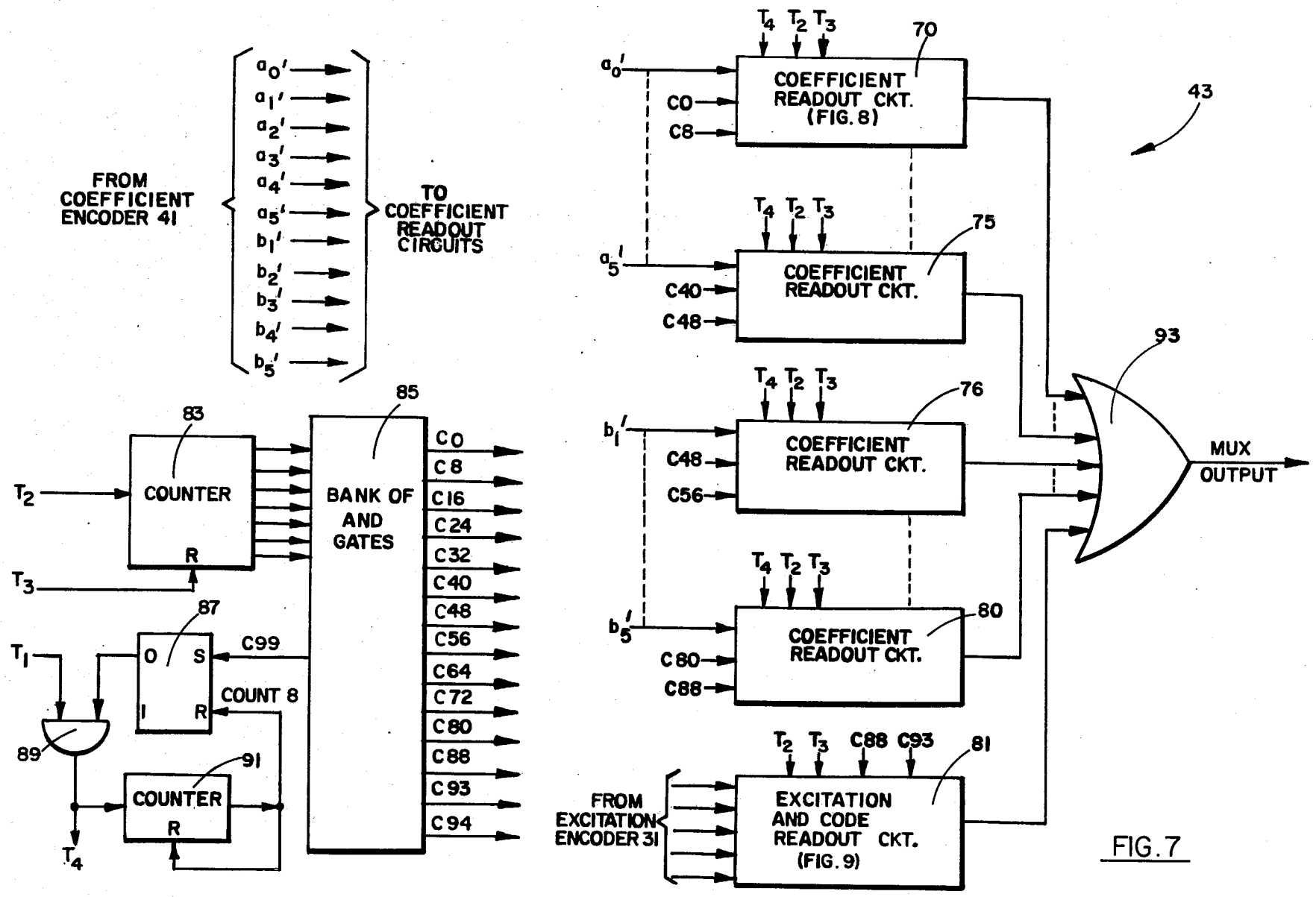
FIG. 7 illustrates a block diagram of one type of multiplexer which may be used in FIG. 1.

Referring now to FIG. 7, a block diagram of the multiplexer 43 of FIG. 1 is illustrated in detail. For purposes of this explanation a parallel data format has been chosen for feeding the coefficient encoder 41 and excitation encoder 31 data outputs to the multiplexer 43. The most significant eight bits in each of the encoded coefficients $a_o'$, $a_1' \ldots a_5'$ and $b_1' \ldots b_5'$ from the encoder 41 are sequentially stored in coefficient readout circuits 70 through 80, respectively, while the five bit output from the counter 65 (FIG. 6) of the encoder 31 is stored in an excitation and code readout circuit 81 on, for example, the rising edge of the $T_3$ clock. It will be recalled that the $T_2$ clock frequency is 10 KHz while the $T_3$ clock frequency is 100 Hz. Therefore, 100 $T_2$ clocks occur within the period of each $T_3$ clock.

A seven bit counter 83 counts the $T_2$ clocks and applies its seven bit output to each AND gate in a bank of AND gates 85. Each of the individual AND gates (not shown) in the bank 85 has seven inputs (not shown) selectively inverted and non-inverted to develop an output 1 state count (C) pulse when the counter 83 reaches an associated count. By this means the bank 85 is implemented to develop 1 state count pulses CO, C8, C16, C24, C32, C40, C48, C56, C64, C72, C80, C88, C93, C94 and C99 when the counter 83 reaches digital counts of zero, 8, 16, 24, 32, 40, 48, 56, 64, 72, 80, 88, 93, 94 and 99. For example, the bank of AND gates 85 will generate the 1 state C64 pulse when the count of the counter 83 reaches a digital count of 64 (1000000). In this case, the most significant bit input of the AND gate which develops the C64 pulse will not be inverted while all other inputs of that AND gate will be logically inverted.

Selected count (C) pulses are applied to the readout circuits 70–81 to enable those circuits to properly multiplex the input coefficient and excitation data. More particularly, the CO and C8, C8 and C16, C16 and C24, C24 and C32, C32 and C40, C40 and C48, C48 and C56,

C56 and C64, C64 and C72, C72 and C80, C80 and C88, and C88 and C93 pairs of pulses are applied to the circuits 70–81, respectively.

The C99 pulse is used to set a flip flop 87 to enable an AND gate 89 to pass $T_1$ clocks to a counter 91 to be counted. Upon reaching a count of eight, the counter 91 generates a "count 8" pulse. This "count 8" pulse resets the flip flop 87 to prevent the AND gate 89 from passing any more $T_1$ pulses. In addition, the "count 8" pulse resets the counter 91 to a zero count. As a result, the AND gate 89 only passes a burst of eight $T_1$ pulses, which will hereafter be designated as $T_4$ clock pulses.

For timing purposes the $T_2$ and $T_3$ clocks are applied to the readout circuits 70–81, while the $T_4$ clocks are only applied to the coefficient readout circuits 70–80.

In the operation of the multiplexer 43 of FIG. 7, the eight-bit long encoded coefficients $a_o'$, $a_1' \ldots a_5'$ and $b_1' \ldots b_5'$ are respectively clocked into the circuits 70–80 at the $T_4$ clock rate. It should be recalled that 100 $T_1$ clocks occur during the period of each $T_2$ clock being counted by the counter 83, and that 100 $T_2$ clocks occur during the period of each $T_3$ clock. Since the $T_4$ clocks (which are essentially a burst of eight $T_1$ clocks) occur after the start of the C99 pulse, the coefficients are stored in the circuits 70–80 for a relatively long time before the end of the C99 pulse. At the end of the C99 pulse, a new $T_3$ clock starts to be generated by the transmitter timing generator 19 (FIG. 1). The rising edge of that new $T_3$ clock resets the counter 83 to a zero count, causing the CO pulse to be generated by the bank 85, and the cycle starts to repeat again.

The rising edge of the $T_3$ clock is also internally utilized by the circuits 70–81 to shift the coefficient and excitation data into readout registers (FIGS. 8 and 9—to be explained later) to ensure that data are selectively read out of the circuits 70–81 at the $T_2$ clock rate in a preselected time division multiplexed format. The time division multiplexed outputs of the readout circuits 70–81 are applied to an OR gate 93. The multiplexed (MUX) output of the OR gate 93 is the output of the multiplexer 43 which is, in turn, applied to both the transmitter 45 and demultiplexer 47 of FIG. 1, as discussed previously.

Figure 8:
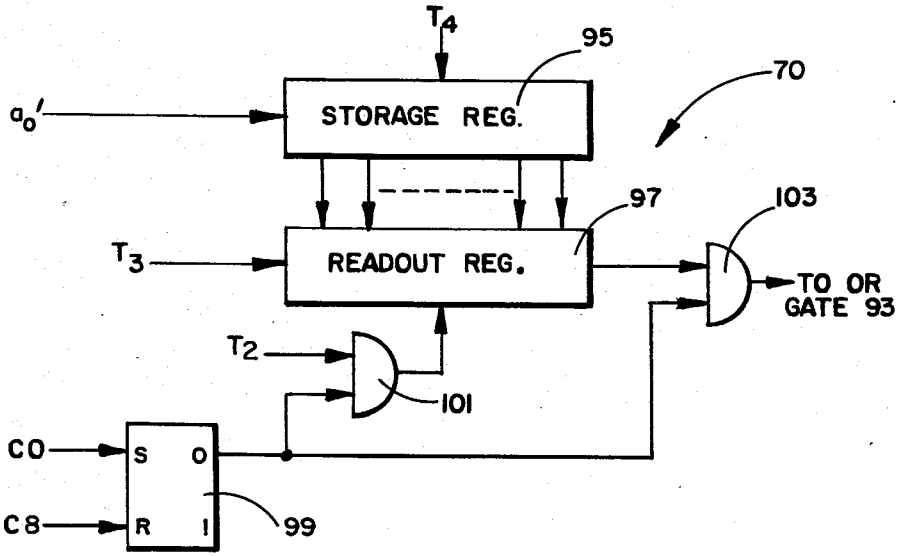
FIG. 8 illustrates a block diagram of one of the coefficient readout circuits of FIG. 7.

A block diagram of one of the coefficient readout circuits of FIG. 7 is illustrated in FIG. 8. Although the description of the circuit of FIG. 8 is specifically directed to the operation of the coefficient readout circuit 70, a similar description with different associated inputs (as shown in FIG. 7) is equally applicable to each of the remaining coefficient readout circuits 71–80 of FIG. 7.

In FIG. 8, the eight-bit long encoded coefficient $a_o'$ is serially loaded into a storage register 95 by the eight $T_4$ clocks. On the rising edge of the $T_3$ clock, the $a_o'$ coefficient in the register 95 is dumped in parallel into a readout register 97. The CO pulse from the bank of AND gates 85 (FIG. 7) sets a flip flop 99 to enable AND gates 101 and 103. Upon being enabled, the AND gate 101 passes $T_2$ clock pulses to the readout register 97. In response to these $T_2$ clocks the register 97 serially clocks the eight bits in the $a_o'$ coefficient through the enabled AND gate 103 to the OR gate 93 (FIG. 7). The C8 pulse from the bank 85 then resets the flip flop 99 to disable the AND gates 101 and 103 to prevent any further data from being erroneously applied from the circuit 70 to the OR gate 93. In a like manner, the $a_1' \ldots a_5'$ and $b_1' \ldots b_5'$ coefficients are sequentially read out of the circuits 71-80 (FIG. 7) to the OR gate 93.

Figure 9:
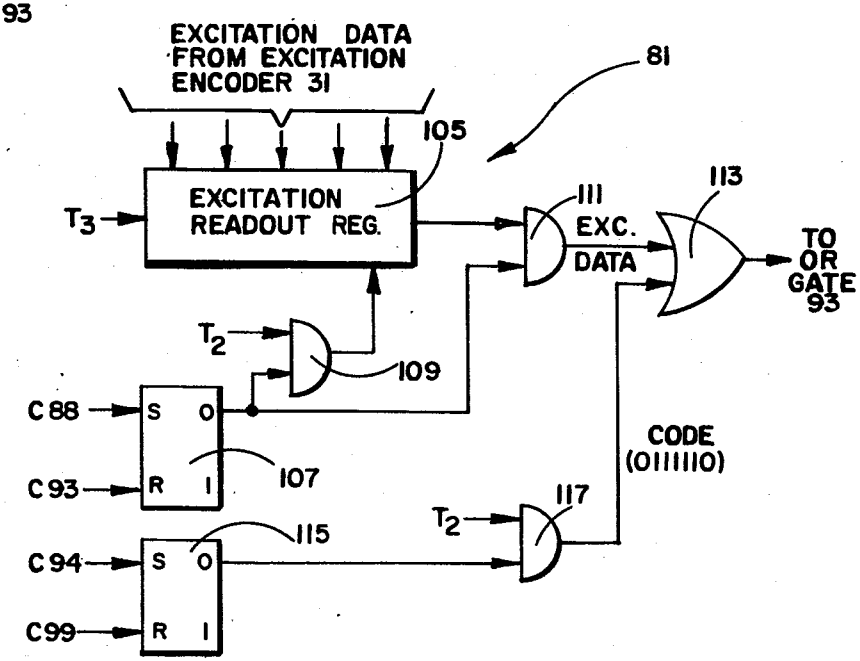
FIG. 9 illustrates a block diagram of the excitation and information readout circuit of FIG. 7.

Referring now to FIG. 9, a block diagram of the excitation and code readout circuit 81 of FIG. 7 is illustrated. On the rising edge of the $T_3$ clock the five-bit encoded excitation data from the excitation encoder 31 (FIGS. 1 and 6) is parallel loaded into an excitation readout register 105. The C88 count pulse from bank 85 (FIG. 7) sets a flip flop 107 to enable AND gates 109 and 111. The enabled AND gate 109 passes $T_2$ clocks to the register 105 to enable the register 105 to serially clock out the five stored encoded excitation bits through the enabled AND gate 111 and through an OR gate 113 to the OR gate 93 (FIG. 7). The C93 count pulse from bank 85 (FIG. 7) is used to reset the flip flop 107 to disable the AND gates 109 and 111 to prevent any further data from being applied through the AND gate 111 to the OR gate 113 until the following C88 pulse is generated during the next $T_3$ clock period. The excitation data is therefore only developed during the C88–C92 count pulse periods of each frame period. During the C93–C99 count pulse periods, the end-of-message code is developed, as will now be explained.

The C94 count pulse is utilized to set a flip flop 115 to enable and AND gate 117 to pass 1 state $T_2$ clock pulses through the OR gate 113 to the OR gate 93. The C99 count pulse, which occurs five count pulse periods after the start the C94 count pulse, resets the flip flop 115 to prevent any further 1 state $T_2$ clocks from being passed through the OR gate 113 until the next C94 count pulse is generated during the period of the next $T_3$ clock (frame period). Since the AND gate 117 is only enabled during the C94–C98 count pulse periods, it is disabled during the C93 and C99 count pulse periods. As a result, the AND gate 117 will develop an end-of-message code of 0111110 during the C93–C99 count pulse periods. The resultant end-of-message code of 0111110 is passed through the OR gate 113 to the OR gate 93 (FIG. 7) to indicate the end of a $T_3$ clock period or the end of the 100-bit message (end-of-message).

In referring back to FIG. 7, it can be seen that the MUX output is comprised of a serial sequence of the eight-bit long encoded coefficients $a_o'$ $a_1' \ldots a_5'$ and $b_1' \ldots b_5'$, followed by the five bits of encoded excitation data and the seven-bit end-of-message code (0111110). This comprises a total of 100 bits of information, each occurring during an associated one of the 100 $T_2$ clock periods contained within the period of a $T_3$ clock. As described before, the period of a $T_3$ clock is also the frame period, or the period of time during which a new block of 100 bits of information (comprised of coefficient and excitation data and the end-of-message code) is transmitted to the synthesizer receiver 15.

Figure 10:
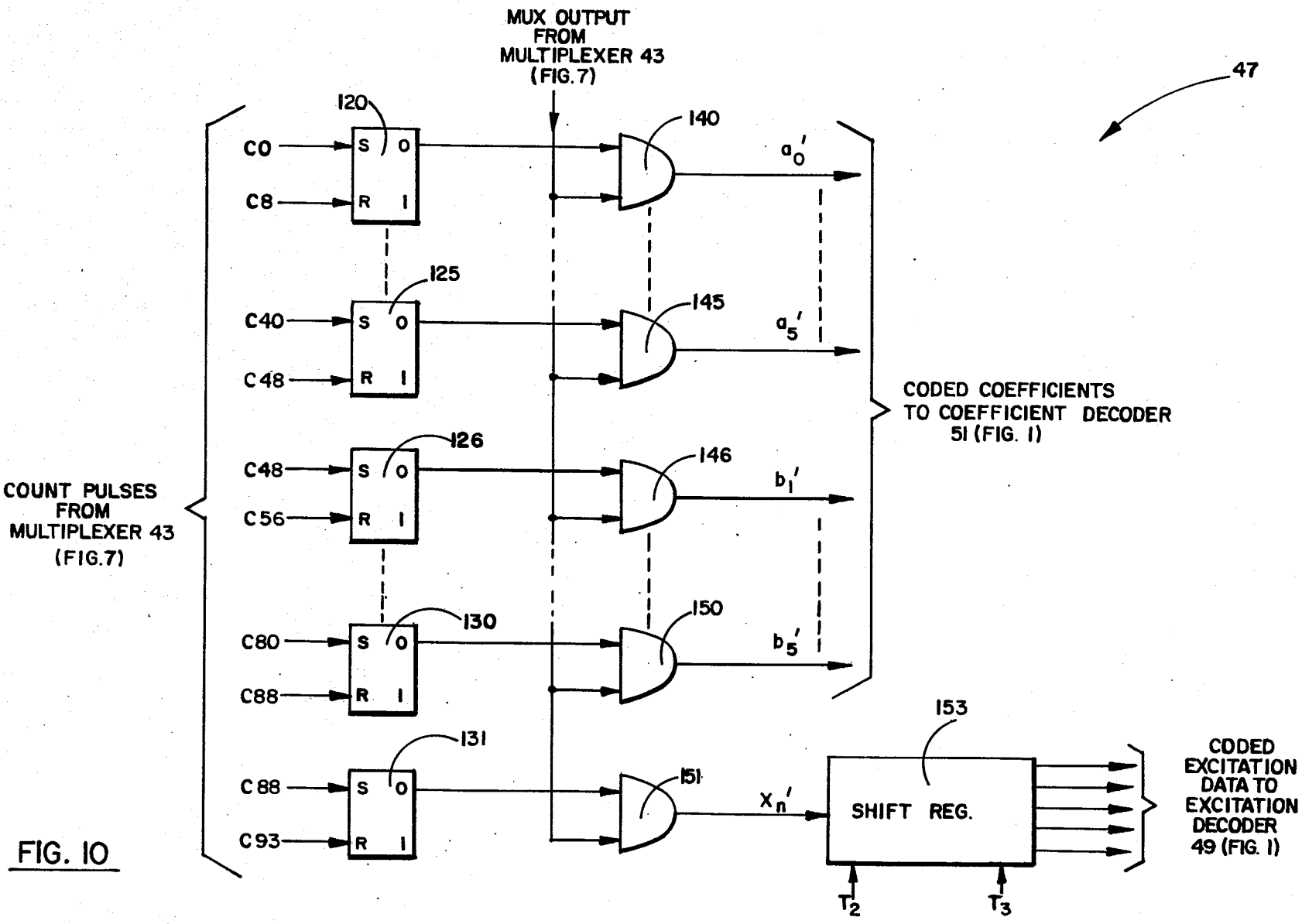
FIG. 10 illustrates a block diagram of one type of demultiplexer which may be used in FIG. 1.

One type of the demultiplexer 47 of FIG. 1 will now be discussed by referring to FIG. 10. Preselected count pulses from the multiplexer 43 (FIG. 7) are selectively utilized by flip flops 120–131 to sequentially enable AND gates 140–151 to demultiplex the coded coefficient and excitation data signals in the multiplexer output from the multiplexer 43. More particularly, the C0, C8, C16, C24, C32, C40, C48, C56, C64, C72, C80 and C88 count pulses are respectively utilized to sequentially set the flip flops 120–131, while the C8, C16, C24, C32, C40, C48, C56, C64, C72, C80, C88 and C93 count pulses are respectively utilized to sequentially reset the flip flops 120–131. By this means the flip flops 120–130 sequentially develop 1 state outputs for eight $T_2$ clock periods each with the flip flop 131 then developing a 1 state output for five $T_2$ clock periods.

The sequential 1 state outputs of the flip flops 120–131 are used to sequentially enable the AND gates 140–151 to demultiplex the multiplexed output from the multiplexer 43 (FIG. 7) into the coded coefficient signals $a_o'$, $a_1' \ldots a_5'$ and $b_1' \ldots b_5'$ and the coded excitation data $x_n'$. These coded coefficient signals are then decoded by the coefficient decoder 51 (FIG. 1).

The demultiplexed coded excitation data signal $x_n'$ from the AND gate 151 is serially clocked into a five-bit long shift register 153 by the $T_2$ clocks. At the time of the $T_3$ clock the five bits of coded excitation data are transferred in parallel into the excitation decoder 49 (FIG. 1), where they are decoded as previously discussed.

It can be seen that the seven-bit long end-of-message code (0111110) is not recovered in the demultiplexer 47, since the speech synthesizer circuit 17 (FIG. 1) is already synchronized with the $T_1$, $T_2$ and $T_3$ clocks. It is only in the synthesizer receiver 15 that the end-of-message code is needed for proper timing recovery and frame timing synchronization.

Figure 11:
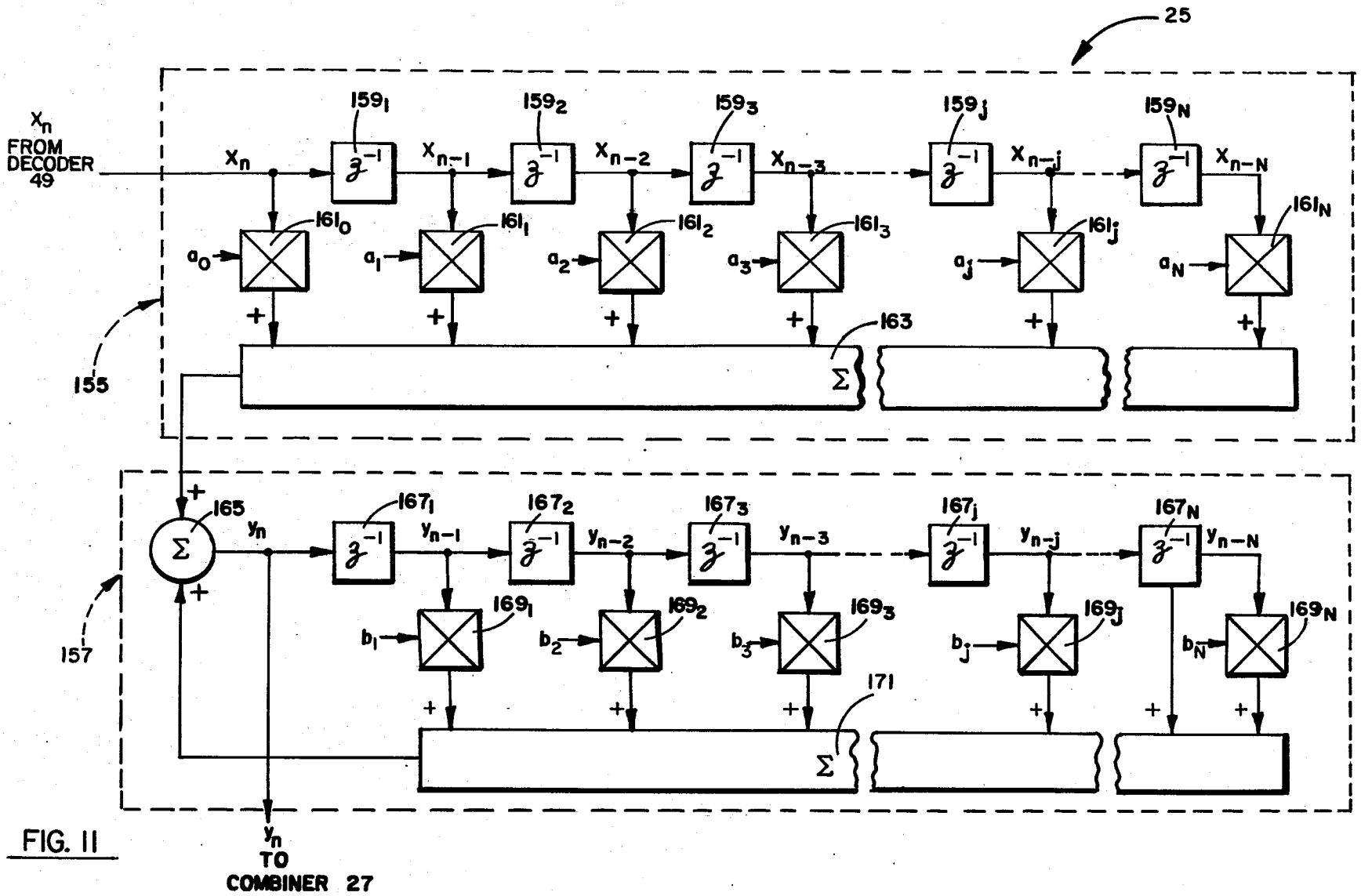
FIG. 11 illustrates a block diagram of the filter of FIG. 1.

Referring now to FIG. 11, a detailed block diagram of the recursive filter 25 (FIG. 1) is illustrated. Basically, the filter 25 comprises a transversal filter 155 and a recursive filter structure 157.

In relation to the transversal filter 155, the excitation signal $x_n$ from the excitation decoder 49 is applied through a sequence of $z^{-1}$ (one sample time delay) blocks $\mathbf{159}_1$, $\mathbf{159}_2$, $\mathbf{159}_3 \ldots \mathbf{159}_j \ldots \mathbf{159}_N$ to respectively develop output delayed signals $X_{n-1}$, $X_{n-2}$, $X_{n-3} \ldots X_{n-j} \ldots X_{n-N}$ therefrom. The $X_n$, $X_{n-1}$, $X_{n-2}$, $X_{n-3} \ldots X_{n-j} \ldots X_{n-N}$ signals are respectively multiplied by the feed forward coefficients $a_o$, $a_1$, $a_2$, $a_3 \ldots a_j \ldots a_N$ from coefficient decoder 51 (FIG. 1) in mulipliers $\mathbf{161}_o$, $\mathbf{161}_1$, $\mathbf{161}_2$, $\mathbf{161}_3 \ldots \mathbf{161}_j \ldots \mathbf{161}_N$, respectively. The outputs of these multipliers are then summed in a summer or summing circuit 163. Essentially the circuits $\mathbf{159}_1 \ldots \mathbf{159}_N$, $\mathbf{161}_o \ldots \mathbf{161}_N$ and 163 cooperate to act as a transversal filter, with the delay circuits $\mathbf{159}_1 \ldots \mathbf{159}_N$ acting as a tapped delay line to the $X_n$ signal and with the tapped outputs respectively weighted in the multipliers $\mathbf{161}_o \ldots \mathbf{161}_N$ by the coefficients $a_o \ldots a_N$ before being summed in the summer 163.

The sun from the summer 163 is fed to the recursive filter structure 157 which comprises a summer 165, $z^{-1}$ (one-sample time delay) blocks $\mathbf{167}_1$, $\mathbf{167}_2$, $\mathbf{167}_3 \ldots \mathbf{167}_j \ldots \mathbf{167}_N$, multipliers $\mathbf{169}_1$, $\mathbf{169}_2$, $\mathbf{169}_3 \ldots \mathbf{169}_j \ldots \mathbf{169}_N$ and summer 171.

In operation the signal outputs of the summers 163 and 171 are summed together in the summer 165 to develop the synthesized speech signal $y_n$ which is applied to the combiner 27 (FIG. 1). The $y_n$ speech signal is also applied through the sequence of time delay blocks $\mathbf{167}_1 \ldots \mathbf{167}_N$ to respectively develop output delayed signals $y_{n-1}$, $y_{n-2}$, $y_{n-3} \ldots y_{n-j} \ldots y_{n-N}$ therefrom. These output delayed signals $y_{n-1} \ldots y_{n-N}$ are respectively multiplied by the feedback coefficients $b_1$, $b_2$, $b_3 \ldots b_j \ldots b_N$ from coefficient decoder 51 (FIG. 1) in the multipliers $\mathbf{169}_1 \ldots \mathbf{169}_N$, respectively. The outputs of the multipliers $\mathbf{169}_1 \ldots \mathbf{169}_N$ are then summed in the summer 171 to develop the signal which is summed in summer 165 with the output of summer 163 to develop the speech signal $y_n$.

It should be noted that the combination of the time delay blocks $\mathbf{167}_1 \ldots \mathbf{167}_N$, the multipliers $\mathbf{169}_1 \ldots \mathbf{169}_N$ and the summer 171 looks like a transversal filter. However, the feedback of the sum of the product signals of the $b$ coefficients and the $y$ state components to the input of the time delay block $\mathbf{167}_1$, via the summer 165, converts the structure 157 to a recursive filter. So this structure 157 is a standard Nth order recursive filter which is mechanized as a tapped delay line by means of the N outputs of the time delay blocks $\mathbf{167}_1 \ldots \mathbf{167}_N$. The driving function of the recursive filter structure 157 is the output of the transversal filter 155 (or the output of the summer 163). Although not shown, each of the time delay blocks, multipliers and summers of FIG. 11 receives the $T_1$ and $T_2$ clocks to enable it to operate at the proper bit and word rates.

The output signals of the recursive filter 25 are $y_n$ and the filter state signals $x_n \ldots x_{n-N}$ and $y_{n-1} \ldots y_{n-N}$. The synthesized speech signal $y_n$ at the output of the summer 165 is applied to the summer 27 (FIG. 1). The filter state signals $x_n \ldots x_{n-N}$ (at the input of the block $\mathbf{159}_1$ and at the outputs of the blocks $\mathbf{159}_1 \ldots \mathbf{159}_N$) and $y_{n-1} \ldots y_{n-N}$ (at the outputs of the blocks $\mathbf{167}_1 \ldots \mathbf{167}_N$) are applied to the filter coefficient computer 39, which will now be discussed.

Figure 12:
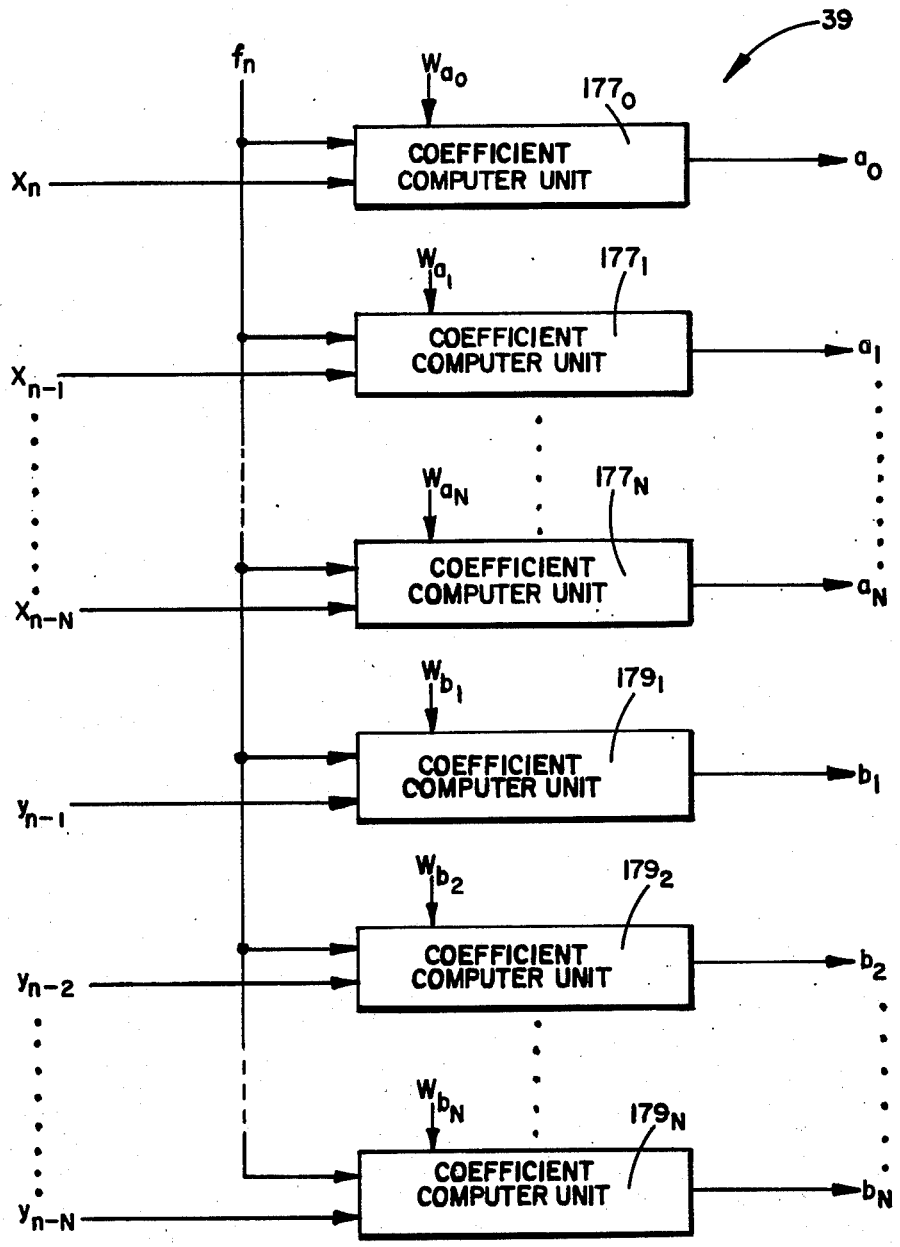
FIG. 12 illustrates a general block diagram of the filter coefficient computer of FIG. 1.

A generalized block diagram of the filter coefficient computer 39 of FIG. 1 is illustrated in FIG. 12. The filter state component signals $x_n \ldots x_{n-N}$ and $y_{n-1} \ldots y_{n-N}$ from the filter 25 are applied to coefficient computer units $\mathbf{177}_o$, $\mathbf{177}_1 \ldots \mathbf{177}_N$ and $\mathbf{179}_1 \ldots \mathbf{179}_N$, respectively, while the scalar signal $f_n$ from the index of performance computer 33 is applied to each of these coefficient computer units. Internally stored constants or weighting values $W_{a0}$, $W_{a_1} \ldots W_{a_N}$ and $W_{b_1} \ldots W_{b_N}$ are also applied to the computer units $\mathbf{177}_o$, $\mathbf{177}_1 \ldots \mathbf{177}_N$ and $\mathbf{179}_1 \ldots \mathbf{179}_N$, respectively.

In response to the $x$ and $y$ filter state component signals, the scalar derivative signal $f_n$ and the weighting values, the computer units $\mathbf{177}_o$, $\mathbf{177}_1 \ldots \mathbf{177}_N$ and $\mathbf{179}_1 \ldots \mathbf{179}_N$ respectively generate new coefficients $a_o$, $a_1 \ldots a_N$ and $b_1 \ldots b_N$. These new coefficients are subsequently used by the filter 25, along with the excitation signal $x_n$, to internally adjust the zeros and poles of the filter 25 to modify the synthesized speech signal $y_n$ and to generate a new set of filter state component signals. The speech signal $y_n$ is modified in order to minimize the error signal $\epsilon_n$ at the output of the combiner 27 (FIG. 1), and hence to minimize the performance criterion $F(\epsilon)$.

By comparing FIGS. 12 and 11, it can be seen that there is a very firm causal relationship between the filter state component signal and coefficient signal that are applied to any given one of the coefficient computer units of FIG. 12. For example, the product of the $x_{n-1}$ and $a_1$ signals is taken by the multiplier $\mathbf{161}_1$ of the filter 25 of FIG. 11, while in FIG. 12 the $x_{n-1}$ signal is one of the inputs which the computer unit $\mathbf{177}_1$ uses to generate a new $a_1$ coefficient. In another example, the product $b_N y_{n-N}$ is taken by the multiplier $\mathbf{169}_N$ in FIG. 11, while in FIG. 12, $y_{n-N}$ is used by the computer unit $\mathbf{179}_N$ to generate the new coefficient $b_N$.

The N+1 units $\mathbf{177}_0$, $\mathbf{177}_1 \ldots \mathbf{177}_N$ compute the coefficients $a_0$, $a_1 \ldots a_N$, which are subsequently used to set the zeros of the recursive filter 25, while the N units $\mathbf{179}_1 \ldots \mathbf{179}_N$ compute the coefficients $b_1 \ldots b_N$ which are used to set the poles of the filter 25.

The weighting values $W_{a0}$, $W_{a1} \ldots W_{aN}$ and $W_{b1} \ldots W_{b_N}$ define the relative importance of the coefficients to be generated. If one coefficient is determined by observation (of the recursive filter 25 that is to be modelled) to be more important than the other coefficients, the associated weighting value for that observed coefficient can be made a large number than the other weighting values in the system. By this means that coefficient will get a larger correction. However, there are relatively few cases in which the design engineer will know in a given application that one coefficient is more important than the others. As a result, in most cases the design engineer will regard all coefficients to be of equal importance and will make all of the weighting values 1's. Therefore, in subsequently explaining the invention, all weighting values, or W's, will be 1's.

Figure 13:
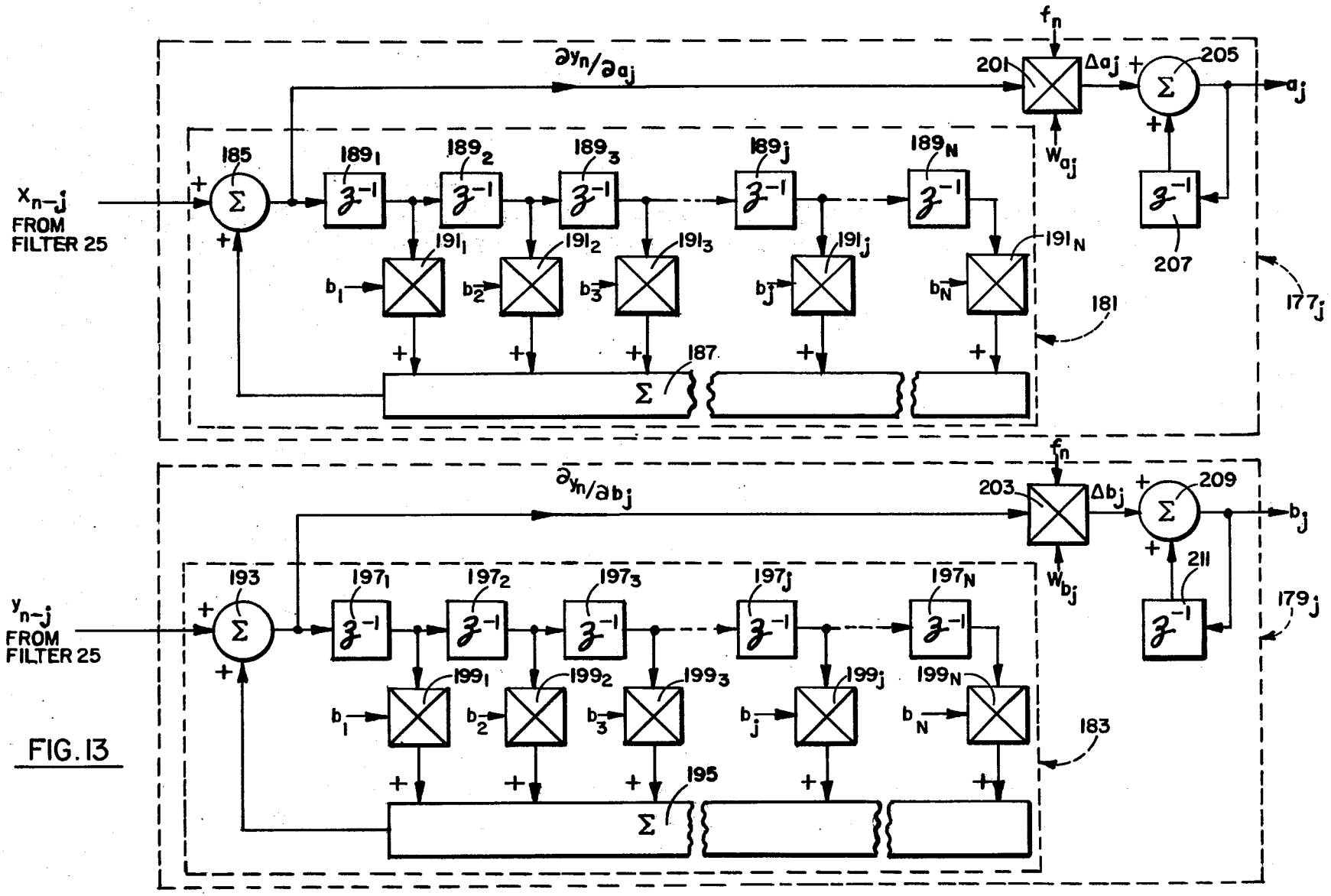
FIG. 13 illustrates a detailed block diagram of two of the coefficient computer units of the filter coefficient computer of FIG. 12.

FIG. 13 illustrates more specific block diagrams of two of the coefficient computer units $177_j$ and $179_j$ of the filter coefficient computer 39 of FIG. 12. The units $177_j$ and $179_j$ generate the $j$th set of filter coefficients, with the unit $177_j$ developing the numerator coefficient $a_j$ and the unit $179_j$ developing the denominator coefficient $b_j$. Respectively contained within the units $177_j$ and $179_j$ are recursive filter structures 181 and 183, each of which is identical in structure and basic operation to the recursive filter structure 157 of FIG. 11.

As can be seen in FIG. 13, summers 185 and 187, $z^{-1}$ delay blocks $189_1 \ldots 189_N$ and multipliers $191_1 \ldots 191_N$ in the filter structure 181 are respectively identical in structure to summers 193 and 195, $z^{-1}$ delay blocks $197_1 \ldots 197_N$ and multipliers $199_1 \ldots 199_N$ in the filter structure 183 which, in turn, are respectively identical in structure to the summers 165 and 171, $z^{-1}$ delay blocks $167_1 \ldots 167_N$ and multipliers $169_1 \ldots 169_N$ in the recursive filter structure 157 of FIG. 11.

In operation only the driving functions respectively applied to the filter structures 181 and 183 differ from the driving function applied to the filter structure 157 of FIG. 11. In the recursive filter 25 of FIG. 11, the driving function to the summer 165 of the structure 157 is the output of the transversal filter 155 within the filter 25 itself. However, the driving functions to the units $177_j$ and $179_j$ (as well as to the other units in the computer 39) are from various states internally derived within the recursive filter 25 of FIG. 11. More specifically, the filter 25 state component $x_{n-j}$ is applied to the summer 185 in the structure 181, while the filter 25 state component $y_{n-j}$ is applied to the summer 193 in the structure 183. Like the filter structure 157, the recursive filter structures 181 and 183 each utilize all the $b$ coefficients $b_1 \ldots b_N$ in the feedback path to the associated input summer 185 or 193. Because of this feedback, each of the states in the $z^{-1}$ delay blocks $189_1 \ldots 189_N$ and $197_1 \ldots 197_N$ is affected by the feedback coefficients $b_1 \ldots b_N$.

Since the driving function signals $x_{n-j}$ and $y_{n-j}$ (to the summers 185 and 193) are only components of the total synthesized speech signal $y_n$ generated by the speech synthesizer 17 of the adaptive recursive filter 25 (FIG. 11) each of the outputs of the summers 185 and 193 can be considered to be the partial derivative of $y_n$ with respect to the coefficient ($a_j$ or $b_j$) being computed by the associated coefficient computer unit ($177_j$ or $179_j$). So basically the structures 181 and 183 are partial derivative generators which, when excited or driven by the signals $x_{n-j}$ and $y_{n-j}$, generate the partial derivatives of $y_n$ with respect to the coefficients most closely coupled to those $x_{n-j}$ and $y_{n-j}$ signals, namely $a_j$ and $b_j$, respectively.

From the outputs of the summers 185 and 193 the partial derivatives of $y_n$ with respect to $a_j$ ($\delta y_n/\delta a_j$) and with respect to $b_j$ ($\delta y_n/\delta b_j$) are applied as first inputs to multipliers 201 and 203. The scalar derivative signal $f_n$ from the index of performance computer 33 (FIG. 2) is applied as a second input to each of the multipliers 201 and 203. The scalar signal $f_n$ indicates how badly the filter coefficient computer 39 computed the previous values of the coefficients $a_0, a_1 \ldots a_N$ and $b_1 \ldots b_N$. Weighting values $W_{aJ}$ and $W_{bJ}$ are also applied as third inputs to the multipliers 201 and 203, respectively. These weighting values indicate how important the coefficients $a_j$ and $b_j$ are in the computation. As indicated before, for purposes of this discussion each of the weighting values, including $W_{aJ}$ and $W_{bJ}$, will be assigned a value equal to 1.

In response to the associated, above-described three inputs, the multipliers 201 and 203 respectively develop correction signals $\Delta a_j$ and $\Delta b_j$, where $\Delta a_j = \delta F(\epsilon)/\delta a_j$ and $\Delta b_j = \delta F(\epsilon)/\delta b_j$. The correction signal $\Delta a_j$ is summed in a summer 205 with the previous $a_j$ value at the output of a $z^{-1}$ time delay block 207 to develop a new $a_j$ coefficient at the output of the summer 205, which is also applied back to the input of the delay block 207. The summer 205 and time delay block 207 form an accumulator which collects error increments. In operation, the output $a_j$ coefficient is fed back through the one-sample time delay block 207. By the time the $a_j$ coefficient passes through the delay block 297, it is the previous value of the $a_j$ coefficient in relation to the new value of $a_j$ coefficient now being developed at the output of the summer 205. It can therefore be seen that each new $a_j$ coefficient is comprised of the sum of the previous value of the $a_j$ coefficient and the newly generated correction value $\Delta a_j$ at the output of the multiplier 201.

Within the coefficient computer unit $179_j$, an accumulator comprised of a summer 209 and time delay block 211 is coupled to the output of the multiplier 203. The multiplier 203, summer 209 and delay block 211 cooperate together to generate a new $b_j$ coefficient or word at the output of the summer 209 at each $T_2$ clock time, in the same manner that the multiplier 201, summer 205 and delay block 207 cooperated together in the unit $177_j$ to generate a new $a_j$ coefficient or word. The remaining coefficient computer units in FIG. 12 are similar in structure and operation to the units $177_j$ and $179_j$ discussed in relation to FIG. 13. Where N = 5, an operation similar to that described for the unit $177_j$ will be performed by coefficient computer units $177_0, 177_1 \ldots 177_5$ and $179_1 \ldots 179_5$ to respectively generate the coefficients $a_0, a_1 \ldots a_5$ and $b_1 \ldots b_5$ in the computer 39. It should be noted that all of the $a_0, a_1 \ldots a_N$ coefficients generated by the units $177_0, 177_1 \ldots 177_N$ (FIG. 12) are respectively applied to the multipliers $161_0, 161_1 \ldots 161_N$ (FIG. 11), while all of the $b_1 \ldots b_5$ coefficients generated by the units $179_1 \ldots 179_N$ (FIG. 12) are respectively applied to the multipliers $169_1 \ldots 169_N$ (FIG. 11), and to the multipliers $191_1 \ldots 191_N$ of the filter structure 181 (FIG. 13), as well as to the multipliers $199_1 \ldots 191_N$ of the filter structure 183 (FIG. 13). In a like manner, all of the $b_1 \ldots b_N$ coefficients are applied to each of the remaining ones of the coefficient computer units $177_0, 177_1 \ldots 177_N$ and $179_1 \ldots 179_N$ of FIG. 12 to enable the computer 39 to generate all of the new output values of the $a$ and $b$ coefficients. Also, although not shown, each of the time delay blocks, multipliers and summers in each of the coefficient computer units of FIG. 12 receive the $T_1$ and $T_2$ clocks to enable it to operate at the proper bit and word rates.

To further aid in the understanding of the operation of this invention, a mathematical analysis of the operation of the analyzer transmitter 11 (FIG. 1) will now be given. It will be recalled that in its operation the analyzer transmitter 11 (FIG. 1) operates to minimize functionals of the instantaneous error between the digitized speech input signal $s_n$ and the synthesized speech signal $y_n$. It can therefore be seen that the error $\epsilon_n$ is minimized during each sampling instant. For illustrative purposes the $n$th sampling instant of time is chosen in the following explanation. It should be understood that a like explanation would apply to each of the other sampling times since they occur sequentially.

In the time domain the input-output relationship of the recursive filter 25 (FIG. 11) at the $n$th, or present ("now"), sampling instant of time can be described by the equation:

$$y_n = a_o x_n + a_1 x_{n-1} + a_2 x_{n-2} + \ldots a_j x_{n-j} + \ldots a_N x_{n-N} + b_1 y_{n-1} + b_2 y_{n-2} + \ldots b_j y_{n-j} + \ldots b_N y_{n-N} \quad (1)$$

In shorthand notation equation (1) may be written:

$$y_n = \sum_{k=0}^{N} a_k x_{n-k} + \sum_{k=1}^{N} b_k y_{n-k}, \quad (2)$$

where $k$ = the running index and $y_n = y(nT)$, the value of $y$ at the *nth* sampling instant of time.

The error $\epsilon_n$ at the output of the combiner 27 (FIG. 1) at the *nth* sampling instant is $$\epsilon_n = s_n - y_n. \quad (3)$$

In substituting the value of $y_n$ from Equation (2), Equation (3) may be rewritten as $$\epsilon_n = s_n - \sum_{k=0}^{N} a_k x_{n-k} - \sum_{k=1}^{N} b_k y_{n-k}. \quad (4)$$

The system operates to minimize the error criterion $F(\epsilon)$ by correcting those values of the parameters or coefficients $a_k$ and $b_k$ which tend to make $F(\epsilon)$ a large number. At any instant of time, the performance criterion or performance index $F(\epsilon)$ which is to be minimized is a number or scalar. At the $n$th instant of time, the scalar performance criterion that is to be minimized is $F_n = F(\epsilon_n)$.

The steep-descent criterion is chosen to be used for coefficient adjustment. This criterion states that the coefficient which contributes the greatest error should be the coefficient which is most quickly corrected (or given the largest correction during the same $n$th instant of time during which the other coefficients are being corrected). Coefficients which contribute less to the error may be corrected more slowly (or given smaller corrections during the $n$th instant). Formally stated this steep-descent criterion is $$\Delta p_n = [W]\,[-\nabla F(\epsilon)], \quad (5)$$

evaluated at the *nth* sampling instant where $\Delta p_n$ is a 2N + 1 vector, and $\nabla$ is the gradient operator. The vector $\Delta p_n$ describes the change or correction of all of the filter coefficients (the $a_k$'s and the $b_k$'s; e.g., $a_j$ and $b_j$ in FIG. 13) in one sample period, i.e., $$\Delta p_n = \begin{Bmatrix} a^n - a^{n-1} \\ b^n - b^{n-1} \end{Bmatrix} = \begin{Bmatrix} \Delta a^n \\ \Delta b^n \end{Bmatrix} \quad (6)$$

when $a^n$ and $b^n$ are vectors whose elements are the values of $a_o, a_1, a_2 \ldots a_N$ and $b_1, b_2 \ldots b_N$ evaluated at time $n$T (the $n$th sampling time).

The matrix [W] in Equation (7) is a diagonal weighting matrix which contains numbers which define the relative importance of the coefficients; i.e., $$[W] = \begin{bmatrix} W_{a0} & & & & & & 0 \\ & W_{a1} & & & & & \\ & & \ddots & & & & \\ & & & W_{aN} & & & \\ & & & & W_{b1} & & \\ & & & & & \ddots & \\ 0 & & & & & & W_{bN} \end{bmatrix} \quad (7)$$

This matrix may be an identity matrix, where all of the quantities along the diagonal are 1's and all of the remaining quantities are 0's. For purposes of this analysis, each of the weighting values (W's) in Equation (7) will be set equal to 1. Then Equation (5) may be rewritten $$\Delta p_n = [-\nabla F(\epsilon)] \quad (8)$$

where $\nabla F(\epsilon)$ is the gradient of the performance index (or performance criterion). It should still be understood that the steep-descent criterion will still be used in this explanation, which criterion will cause the coefficient that causes the greatest error to be given the largest correction.

The gradient of the performance index vector, $\nabla F(\epsilon)$ is the partial derivative of $F(\epsilon)$ with respect to each of the coefficients of the filter 25, evaluated at the time $n$T. Let the scalar derivative $f_n$ from the index of performance computer 33 at the time $n$T be defined as:

$$f_n = \frac{dF(\epsilon)}{d\epsilon_n} = \frac{\frac{dF(\epsilon)}{d\epsilon}}{\epsilon} = \epsilon_n \quad (9)$$

Then the negative of the gradient of the performance index vector can be written:

$$-\nabla F(\epsilon) = -\begin{Bmatrix} \frac{\delta F(\epsilon)}{\delta a_0} \\ \frac{\delta F(\epsilon)}{\delta a_1} \\ \vdots \\ \frac{\delta F(\epsilon)}{\delta a_N} \\ \frac{\delta F(\epsilon)}{\delta b_1} \\ \frac{\delta F(\epsilon)}{\delta b_2} \\ \vdots \\ \frac{\delta F(\epsilon)}{\delta b_n} \end{Bmatrix} = -\begin{Bmatrix} \frac{\delta f(\epsilon)}{\delta a^n} \\ \frac{\delta F(\epsilon)}{\delta b^n} \end{Bmatrix} = \quad (10)$$

-continued $$-\frac{dF(\epsilon)}{d\epsilon_n}\left\{\begin{matrix}\frac{\delta\epsilon_n}{\delta a^n}\\ \\ \frac{\delta\epsilon_n}{\delta b^n}\end{matrix}\right\} = f_n\left\{\begin{matrix}\frac{\delta y_n}{\delta a^n}\\ \\ \frac{\delta y_n}{\delta b^n}\end{matrix}\right\}$$

with each of the partial derivatives of $F(\epsilon)$ with respect to the $a$ and $b$ coefficients being a scalar. The sign of gradient of the performance index is inverted because the ultimate operational goal is to minimize the performance criterion $F(\epsilon)$.

Since FIG. 13 illustrates the specific portion of the filter coefficient computer 39 that is implemented to derive the new corrected values of the $a_j$ and $b_j$ coefficients, the remaining part of this mathematical analysis will be directed toward deriving those new corrected values of the $a_j$ and $b_j$ coefficients. However, it should be understood that a similar analysis applies to the derivation of the new corrected values for the remaining ones of the coefficients, $a_0$, $a_1$ and $b_1$, $a_2$ and $b_2 \ldots a_N$ and $b_N$.

From Equation (10), by use of the chain rule, the partial derivatives of $F(\epsilon)$ with respect to the $a_j$ and $b_j$ coefficients may be respectively written:

$$\frac{\delta F}{\delta a_j} = \frac{dF(\epsilon)}{d\epsilon_n}\ \frac{\epsilon_n}{\delta a_j} = \Delta a_j \tag{11}$$

and $$\frac{\delta F}{\delta b_j} = \frac{dF(\epsilon)}{d\epsilon_n}\ \frac{\delta\epsilon_n}{\delta b_j} = \Delta b_j \tag{12}$$

The $\Delta a_j$ and $\Delta b_j$ correction signals respectively appear at the outputs of the multipliers 201 and 203 in FIG. 13. These $\Delta a_j$ and $\Delta b_j$ signals are respectively combined in the summers 205 and 209 with the respective values of the $a_j$ and $b_j$ coefficients developed during the $n-1$ sampling time in order to develop the new corrected values of the $a_j$ and $b_j$ coefficients during the *nth* sampling time. The components of the $\Delta a_j$ and $\Delta b_j$ signals in Equations (11) and (12) will now be analyzed.

It has been previously shown in Equation (9) that the quantity $dF(\epsilon)/d\epsilon_n$ in Equations (11) and (12) is the scalar derivative from the index of performance computer 33. This scalar derivative is shown in FIG. 13 as being applied to the multipliers 201 and 203.

The signals $\delta\epsilon_n/\delta a_j$ and $\delta\epsilon_n/\delta b_j$ in Equations (11) and (12) are derived in the following manner. By substituting the value of $\epsilon_n$ from Equation (3), the expressions $\delta\epsilon_n/\delta a_j$ and $\delta\epsilon_n/\delta b_j$ in Equations (11) and (12) become:

$$\frac{\delta\epsilon_n}{\delta a_j} = \frac{\delta}{\delta a_j}[s_n - y_n] = \frac{\delta s_n}{\delta a_j} - \frac{\delta y_n}{\delta a_j} \tag{13}$$

and $$\frac{\delta\epsilon_n}{\delta b_j} = \frac{\delta}{\delta b_j}[s_n - y_n] = \frac{\delta s_n}{\delta b_j} - \frac{\delta y_n}{\delta b_j}. \tag{14}$$

Since $s_n$, the digitized input signal at time $n$T, is not affected by either $a_j$ or $b_j$, the terms $\delta s_n/\delta a_j$ and $\delta s_n/\delta b_j$ in Equations (13) and (14), respectively, are each equal to zero. Therefore, by eliminating the terms $\delta s_n/\delta a_j$ and $\delta s_n/\delta b_j$ and substituting the value of $y_n$ from Equation (2), Equations (13) and (14) can be rewritten:

-continued $$\frac{\delta\epsilon_n}{\delta a_j} = -\frac{\delta y_n}{\delta a_j} = \frac{\delta}{\delta a_j}\left[-\sum_{k=0}^{N} a_k x_{n-k} - \sum_{k=1}^{N} b_k y_{n-k}\right] \tag{15}$$

and $$\frac{\delta\epsilon_n}{\delta b_j} = -\frac{\delta y_n}{\delta b_j} = \frac{\delta}{\delta b_j}\left[-\sum_{k=0}^{N} a_k x_{n-k} - \sum_{k=1}^{N} b_k y_{n-k}\right] \tag{16}$$

Taking the partial derivative of all of the terms of $y_n$ in Equation (15) with respect to $a_j$, all of the $x$-terms drop out except the term directly associated with $a_j$, while all of the $y$-terms remain. As can be seen in Equation (1), only the $x$-terms $a_j x_{n-j}$ is affected by $a_j$, whereas any change in any of the $a_0$, $A_1 \ldots a_j \ldots a_N$ and $b_1 \ldots b_j \ldots b_N$ coefficients will affect the value of $y_n$ which, in turn, will cause a change in all of the $y$-values $y_{n-1}$, $y_{n-2} \ldots y_{n-N}$. This operation is shown in Equation (17) below.

$$\frac{\delta y_n}{\delta a_j} = x_{n-j} + \sum_{k=1}^{N} b_k \frac{\delta y_{n-k}}{\delta a_j} \tag{17}$$

In a like manner, taking the partial derivative of all of the terms $y_n$ in Equation (16) with respect to $b_j$, all of the $x$-terms drop out (since none of them is affected by $b_j$) and, while only the $y$-term $b_j y_{n-j}$ is directly affected by $b_j$, all of the $y$-terms are indirectly affected by $b_j$ (as explained above). This operation is shown in Equation (18) below.

$$\frac{\delta y_n}{\delta b_j} = y_{n-j} + \sum_{k=1}^{N} b_k \frac{\delta y_{n-k}}{\delta b_j} \tag{18}$$

An examination of Equations (17) and (18) should readily reveal their recursive nature.

The $\delta y_n/\delta a_j$, $dF(\epsilon)/d\epsilon_n$ and $W_{aj}$ signals are multiplied together in the multiplier 201 to develop the $\Delta a_j$ correction signal. In a like manner the $\delta y_n/\delta b_j$, $dF(\epsilon)/d\epsilon_n$ and $W_{bj}$ signals are multiplied together in the multiplier 203 to develop the $\Delta b_j$ correction signal. It will be recalled that for purposes of this explanation $W_{aj}$ and $W_{bj}$ were each given a value of unity or one (1). It should be understood that other values for the W's could have been used in the explanation to obtain larger correction values within the purview of the invention without changing the concepts of the invention.

In a similar manner the remaining ones of the $a_0$, $a_1 \ldots a_N$ and $b_1$, $b_2 \ldots b_N$ coefficients in FIG. 12 are corrected during the *nth* sampling instant in order to develop a new value of $y_n$ to minimize $\epsilon_n$ and hence to mimimize the scalar performance criterion $F_n$ of the index of performance computer 33. It can therefore be seen that at each sampling instant of time the analyzer transmitter 11 (FIG. 1) acts to develop a synthesized speech signal $y_n$ to drive the residual or error signal $\epsilon_n$ to zero in order to minimize the magnitude of the scaler $f_n$, and hence minimize the performance criterion $F(\epsilon)$.

It should be noted at this time that the basic convergence requirement of the system is that the slope of the surface of the performance criterion or performance index $F(\epsilon)$ always be directed to the minimum. From elementary calculus, three necessary conditions are imposed on the performance criterion $F(\epsilon)$ in order to permit the individual coefficient-tracking servos (included in the adaptive servo loop of the analyzer transmitter 11 of FIG. 1) to seek a stable solution. These three conditions are that:

1. $f(O) = 0$
2. $\epsilon_n f_n > 0$ for all values of $\epsilon_n \neq 0$
3. $df_n/d\epsilon_n > 0$ when $\epsilon_n = 0$ The performance criterion surface of any of the curves illustrated in FIGS. 3A, 4A and 5A is a valid one because $$F(\epsilon) = \int_0^{\epsilon} f_n d\epsilon_n$$

and the above three conditions imposed on the performance criterion $F(\epsilon)$ are met. As a result, each of the curves illustrated in FIGS. 3B, 4B and 5B meet all the convergence requirements discussed above.

Referring back to the synthesizer receiver 15 of FIG. 1, it will be recalled that the purpose of the receiver timing generator 57 is to develop the $T_1'$, $T_2'$ and $T_3'$ clocks in synchronism with the clocked data information from the receiver 53 and the $T_2'$ clocks from the timing recovery circuit 55. This $T_2'$ clock from the circuit 55 is a 10 KHz clock which establishes the transmission bit time which is used by the generator 57 and other circuits in the synthesizer receiver 15 to perform their previously indicated operations. A major purpose of the timing generator 57 is to establish the $T_3'$ clock, or the frame period during which a 100-bit block of data is generated. The $T_3'$ clock should be synchronized to the start of the first $T_2'$ clock that occurs within the 100-bit block of data for coherent data recovery. It will be recalled that within each 100-bit block of input data the eleven 8-bit long encoded coefficients $a_o'$, $a_1' \ldots a_5'$ and $b_1' \ldots b_5'$ precede the 5-bit long encoded excitation data which, in turn, is followed by an end-of-message code (0111110) to identify the end of that block of data. The timing generator 57 operates to utilize the end-of-message code to generate the $T_3'$ clock in order to synchronize the operation of the synthesizer receiver 15 (FIG. 1) with the frame period inherent in the received serial data stream. This operation will be more fully described by now referring to FIG. 14, which illustrates a block diagram of one type of receiver timing generator 57 that can be used in FIG. 1.

Figure 14:
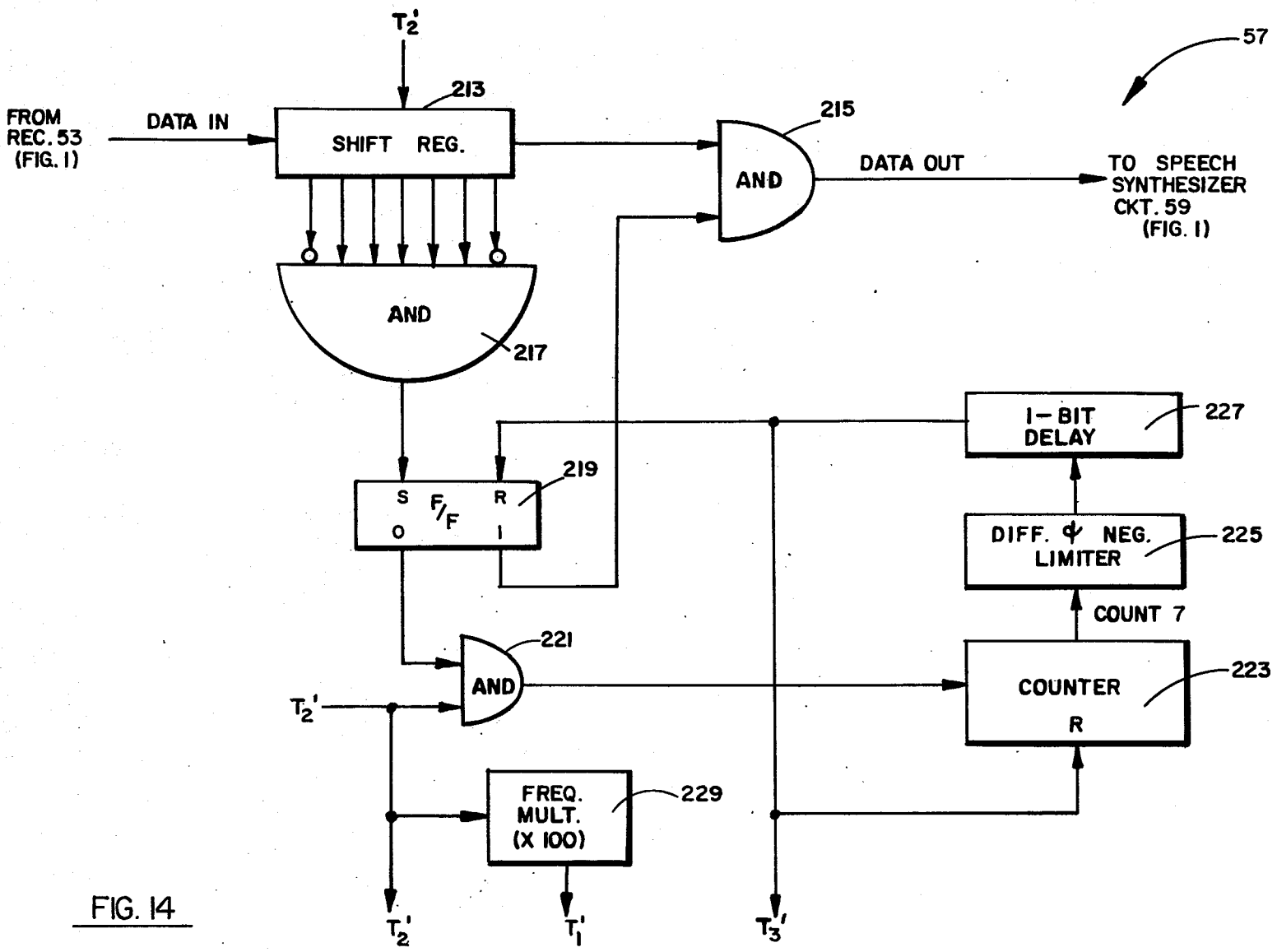
FIG. 14 illustrates a block diagram of one type of receiver timing generator which may be used in FIG. 1.

In FIG. 14, the serial data stream of 100-bit long blocks of input data from the receiver 53 (FIG. 1) is serially clocked through a seven-bit long shift register 213 by the $T_2'$ clocks from the timing recovery circuit 55 (FIG. 1). This data stream output of the register 213 is applied to one input of an AND gate 215. As will be explained, a second input to the AND gate 215 enables the AND gate 215 to only pass the bits in the coefficient and excitation data signals to the speech synthesizer circuit 59 (FIG. 1). This second input to the AND gate 215 disables the gate 215 during the time that the end-of-message code is being received to prevent that code from appearing in the data output to the speech synthesizer circuit 59.

During each $T_2'$ clock period, the seven bits stored in the register 213 are applied in parallel to an AND gate 217. The least and most significant bits to the AND gate 217 are inverted so that the AND gate 217 only develops a 1 state output when the complete end-of-message code of 0111110 is stored in the register 213. Consequently, the AND gate 217 only develops a 1 state output during the $T_2'$ clock period which corresponds to the count pulse period C99 of the bank of AND gates 85 (FIG. 7). At this time the 1 state output of the AND gate 217 sets a flip flop 219 to disable the AND gate 215 and to enable an AND gate 221 to pass $T_2'$ clocks to a counter 223. The counter 223 counts the number of $T_2'$ clocks. As soon as the counter 223 counts seven $T_2'$ clocks, it applies a "count 7" pulse to a differentiator and negative limiter circuit 225. The leading edge of the "count 7" pulse is delayed one-bit time (period of a $T_2'$ clock) by a delay circuit 227. The output positive pulse from the delay circuit 227 therefore coincides in time with the end of the end-of-message code, or with the start of a new frame period. As a result, this positive pulse from the delay circuit 227 will be used in the synthesizer receiver 15 as the $T_3'$ clock. This $T_3'$ clock is also used to reset the flip flop 219 and to reset the counter 223 to a zero count. Upon being reset the flip flop 219 disables the AND gate 221 to prevent any further $T_2'$ clocks from being applied to the counter 223. At this same time the reset flip flop 219 also enables the AND gate 215 to again pass coefficient and excitation data signals to the speech synthesizer 59 (FIG. 1). As soon as the end-of-message code of 0111110 is again completely stored in the register 213, the above-described cycle of operation repeats.

The frequency of the $T_2'$ clock is multiplied by 100 in a frequency multiplier 229 in order to develop the 1 MHz $T_1'$ clock.

The invention thus provides, in one embodiment, an improved analyzer/synthesizer system which utilizes adaptive recursive filters. In this system, an input periodically develops an error signal when a first synthesized speech signal does not correspond to a sampled input speech signal. An output circuit is responsive to the error signal and to first state signals for developing multiplexed speech data signals. These multiplexed speech data signals are fed back to a first speech synthesizer circuit which demultiplexes the signal and utilizes the demultiplexed signal in a first recursive filter to control the development of the first synthesized speech signal and the first state signals. The multiplexed speech data signals from the output circuit are also transmitted to a receiver which demultiplexes and applies the demultiplexed transmitted speech data signals to a second recursive filter to control the development of a second synthesized speech signal by the second recursive filter. This second synthesized speech signal is then converted into an output speech signal which substantially sounds like the input speech signal.

While the salient features have been illustrated and described in a preferred embodiment of the invention, it should be readily apparent to those skilled in the art that many changes and modifications can be made in the preferred embodiment without departing from the spirit and scope of the invention. For example, the system could be modified to operate with serial data rather than parallel data, or vice versa, or even some other combination of serial and parallel data. Furthermore, the system could have been implemented differently and with different timing of clock signals. It is therefore intended to cover all such changes and modifications of the invention that fall within the spirit and scope of the invention as set forth in the appended claims.

I claim:

1. A system comprising:

input means responsive to an input speech signal and to a feedback digital speech signal for developing an error signal;

first means for extracting excitation signals from the error signal;

second means for developing a performance measure signal as a function of the error signal;

a first recursive filter responsive to feedforward and feedback filter coefficient value signals and to the excitation signals for developing filter state signals and the feedback digital speech signal to minimize the error signal; and third means responsive to the performance measure signal and the filter state signals for developing the feedforward and feedback filter coefficient value signals, the feedforward and feedback filter coefficient value signals. causing said first recursive filter to converge to minimize the error signal.

2. The system of claim 1 further including:

fourth means responsive to the excitation signals and filter coefficient value signals for developing speech data signals;

fifth means responsive to the speech data signals for developing and applying the excitation signals and filter coefficient value signals to said first recursive filter;

means for transmitting the speech data signals; and synthesizing means responsive to the transmitted speech data signals for synthesizing an output speech signal which substantially sounds like the input speech signal.

3. The system of claim 2 wherein said fourth means comprises:

means responsive to the excitation signals for developing encoded excitation signals;

means responsive to the filter coefficient value signals for developing encoded filter coefficient value signals; and means responsive to the encoded excitation signals and the encoded filter coefficient value signals for developing the speech data signals.

4. The system of claim 3 wherein said fifth means comprises:

sixth means for separating the speech data signals into the encoded excitation signals and the encoded filter coefficient value signals;

means responsive to the encoded excitation signals for applying excitation signals to said first recursive filter; and means responsive to the encoded filter coefficient value signals for applying filter coefficient value signals to said first recursive filter.

5. The system of claim 4 wherein said synthesizing means comprises:

means for receiving the transmitted speech data signals;

seventh means coupled to said receiving means for separating the received speech data signals into received excitation signals and received filter coefficient value signals;

a second recursive filter coupled to said sixth means for developing a synthesized digital speech signal in response to the received excitation signals and received filter coefficient value signals; and means for converting the synthesized digital speech signal into the output speech signal.

6. The system of claim 5 wherein said input means comprises:

means for converting the input speech signal into a digitized speech signal; and means for comparing the digitized speech signal with the feedback digital speech signal to develop the error signal.

7. The system of claim 5 wherein:

said means for developing the speech data signals is a multiplexer; and each of said sixth the fifth means is a demultiplexer

8. A system comprising:

means for comparing an input digital signal with a first synthesized digital signal to develop an error signal;

first means responsive to the error signal for developing signal data;

second means responsive to the error signal and to filter state signals for developing feedforward and feedback filter coefficient value signals; and a first recursive filter responsive to the signal data and feedforward and feedback filter coefficient value signals for producing the first synthesized digital signal and the filter state signals, the feedforward and feedback filter coefficient value signals causing the said first recursive filter to converge to minimize the error signals.

9. The system of claim 8 wherein said first means comprises:

a threshold circuit for thresholding the error signal to develop the signal data therefrom.

10. The system of claim 9 wherein said second means comprises:

first computing means responsive to the error signal for developing a performance measure signal as a function of the error signal; and second computing means responsive to the performance measure signal from said first computing means and to the filter state signals for computing the feedforward and feedback filter coefficient data.

11. The system of claim 10 further including:

third means responsive to the signal data for developing a first encoded signal;

fourth means responsive to the filter coefficient value signals for developing a second encoded signal;

fifth means for combining the first and second encoded signals;

sixth means for separating the combined first and second encoded signals into the first and second encoded signals;

means responsive to the first encoded signal for applying signal data to said first recursive filter; and means responsive to the second encoded signal for applying the filter coefficient value signals to said first recursive filter.

12. The system of claim 11 further including:

means coupled to said fifth means for transmitting the combined first and second encoded signals;

means for receiving the transmitted combined first and second encoded signals;

means coupled to said receiving means for separating the received combined first and second encoded signals into received first and second encoded signals;

means for producing received signal data in response to the first encoded signal;

means for producing received feedforward and feedback filter coefficient value signals in response to the second encoded signal;

a second recursive filter being responsive to the received signal data and received filter coefficient value signals for adaptively developing a second synthesized digital speech signal which is substantially a duplication of the input digital signal to said comparing means.

13. A system comprising:

means for converting an input analog speech signal into a digital speech signal;

means for combining the digital speech signal with a first synthesized digital speech signal to develop an error signal;

means responsive to the error signal for developing excitation signals;

means responsive to the excitation signals for developing excitation data;

means for developing a performance measure signal as a function of the error signal;

means responsive to the performance measure signal and to filter state signals for developing feedforward and feedback filter coefficient value signals;

multiplexing means responsive to the excitation signals and the feedforward and feedback filter coefficient value signals for developing multiplexed signals;

a first demultiplexer coupled to said multiplexing means for demultiplexing the multiplexed signals to separate the excitation signals from the filter coefficient value signals;

a first recursive filter coupled to said first demultiplexer for developing the first synthesized digital speech signal and the filter state signals in response to the excitation signals and filter coefficient value signals;

means coupled to said multiplexing means for transmitting the multiplexed signals;

means for receiving the multiplexed signals being transmitted from said transmitting means;

a second demultiplexer coupled to said receiving means for demultiplexing the received multiplexed signals into received excitation signals and received feedforward and feedback filter coefficient value signals;

a second recursive filter coupled to said second demultiplexer for developing a received digital speech signal in response to the received excitation signals and received filter coefficient value signals; and means responsive to the received digital speech signal for synthesizing an output analog speech signal which sounds like the input analog speech signal.

14. A system comprising:

means for converting an input analog speech signal into a digitized speech signal;

means for comparing the digitized speech signal with a first synthesized digital speech signal to develop an error signal;

a threshold circuit coupled to said comparing means for thresholding the error signal to develop excitation pulses therefrom;

a first encoder for encoding the excitation pulses to develop excitation data;

first computing means coupled to said comparing means for developing a performance measure signal as a function of the error signal;

second computing means responsive to the performance measure signal from said first computing means and to filter state component signals for computing feedforward and feedback filter coefficient value signals;

a second encoder for encoding the feedforward and feedback filter coefficient value signals to develop coefficient data;

a multiplexer for multiplexing the excitation data with the coefficient data to develop multiplexed data signals;

a first demultiplexer coupled to said multiplexer for demultiplexing the multiplexed data signals to separate the coefficient data from the excitation data;

a first decoder coupled to said first demultiplexer for developing excitation pulses in response to the excitation data;

a second decoder responsive to the coefficient data for developing feedforward and feedback filter coefficient value signals;

a first recursive filter responsive to the excitation pulses and feedforward and feedback filter coefficient value signals for developing the first snythesized digital speech signal and the filter state component signals;

means coupled to said multiplexer for transmitting the multiplexed data signals;

means for receiving the multiplexed data signals being transmitted from said transmitting means;

a second demultiplexer coupled to said receiving means for demultiplexing the received multiplexed data signals into received excitation data and received coefficient data;

a third decoder responsive to the received excitation data for developing received excitation pulses;

a fourth decoder responsive to the received coefficient data for developing received feedforward and feedback filter coefficient value signals;

a second recursive filter coupled to said third and fourth decoders for developing a second synthesized digital speech signal in response to the received excitation. pulses and received feedforward and feedback filter coefficient value signals; and means for converting the second synthesized digital speech signal into an output analog speech signal that substantially sounds like the input analog speech signal.

* * * * *